US005616877A

United States Patent [19]

Tamura et al.

[11] Patent Number: 5,616,877

[45] Date of Patent: Apr. 1, 1997

[54] AUTOMATIC PERFORMACE DEVICE

[75] Inventors: Motoichi Tamura; Takeo Shibukawa, both of Hamamatsu, Japan

[73] Assignee: Yamaha Corporation, Japan

[21] Appl. No.: 662,905

[22] Filed: Jun. 11, 1996

Related U.S. Application Data

[63] Continuation of Ser. No. 266,121, Jun. 20, 1994, abandoned.

[30] Foreign Application Priority Data

Jul. 23, 1993 [JP] Japan ..... 5-202641

[51] Int. Cl.[6] ..... A63H 5/00; G04B 13/00; G10H 7/00

[52] U.S. Cl. ..... 84/609; 84/634

[58] Field of Search ..... 84/609–612, 634–636

[56] References Cited

U.S. PATENT DOCUMENTS

| | | | |
|---|---|---|---|
| 4,847,710 | 7/1989 | Morioka et al. | 84/642 |
| 5,233,521 | 8/1993 | Kimpara | 84/609 |
| 5,357,046 | 10/1994 | Matsui et al. | 84/609 |
| 5,393,927 | 2/1995 | Aoki | 84/63 |

FOREIGN PATENT DOCUMENTS

| | | |
|---|---|---|
| 1-180596 | 7/1989 | Japan . |
| 3-56997 | 3/1991 | Japan . |

*Primary Examiner*—William M. Shoop, Jr.
*Assistant Examiner*—Jeffrey W. Donels
*Attorney, Agent, or Firm*—Graham & James LLP

[57] ABSTRACT

An automatic performance device has a RAM for storing automatic performance information formed of time information and performance information containing time change information. A CPU instructs updating of an automatic performance position within the automatic performance information measure by measure. In response to the instruction, searching is made of the head location of a desired measure in the automatic performance information, by reading out the performance information of the automatic performance information from the RAM, based on the time information, and counting time corresponding to each measure in the performance information read out to obtain a count value of the time. The reading-out is continued until the head location of the desired measure is searched out. When the time change information is read out during the searching, the count value of the time corresponding to one measure in which the time change information is read out, is corrected, based on the time change information.

8 Claims, 23 Drawing Sheets

AUTOMATIC PERFORMACE DEVICE

This is a continuation of application Ser. No. 08/266,121 filed on Jun. 20, 1994, now abandoned.

BACKGROUND OF THE INVENTION

1. Field of the Invention

This invention relates to an automatic performance device for electronic musical instruments, and more particularly to an automatic performance device which is capable of searching automatic performance data by means of fast forward (FF) or rewind (REW) function, measure by measure.

2. Prior Art

Conventionally, there are used automatic performance devices which carry out automatic performance by reading performance data from a memory at given tempo. Some conventional automatic performance devices are provided with fast forward (FF) and rewind (REW) functions for high-speed searching of a portion of performance data a musical tone from which the user desires to listen to. Such automatic performance devices are adapted to read performance data at a high speed by moving the reading pointer forward or backward by a predetermined amount and stopping the pointer at a desired point of the performance data, by means of the fast forward and rewind functions, as proposed, e.g. by Japanese Provisional Patent Publication (Kokai) No. 1(1989)-180596.

However, the predetermined amount by which the pointer is moved each time is always set to a fixed amount, e.g. an amount corresponding to one measure. As a result, when a change occurs in the time due to time data provided at an intermediate portion of the performance data while searching is carried out by using such fast forward or rewind function, the pointer can be often stopped at a point different from a measure line. Further, according to the conventional automatic performance devices, the stopping point is determined by counting time information contained in the performance data, which requires much time for the searching to be performed.

SUMMARY OF THE INVENTION

It is a first object of the invention to provide an automatic performance device which is capable of achieving searching of automatic performance data measure by measure without the reading pointer being stopped at a point different from the head of a measure even when the time is changed during searching of the performance data.

A second object of the invention is to provide an automatic performance device which is capable of carrying out rewind operation at a high speed.

A third object of the invention is to provide an automatic performance device which is capable of achieving searching in an optimal manner selected according to data contained in performance information in automatic performance data.

In a first aspect of the invention, to attain the first object, there is provided an automatic performance device comprising:

memory means for storing automatic performance information comprising time information and performance information, the performance information containing time change information;

instruction means for instructing updating of an automatic performance position within the automatic performance information measure by measure; and searching means responsive to an instruction from the instruction means, for searching a location of a head of a desired measure in the automatic performance information, by reading out the performance information of the automatic performance information from the memory means, based on the time information, and counting time corresponding to each measure in the performance information read out to obtain a count value of the time, and continuing the reading-out until the location of the head of the desired measure is searche out;

wherein when the time change information is read out during the searching, the searching means corrects the count value of the time corresponding to one measure in which the time change information is read out, based on the time change information.

Preferably, the searching means corrects the count value of the time, based on a number of clocks corresponding to time contained in the time change information and a difference between a time length of the one measure in which the time change information is read out, the time length corresponding to the time contained in the time change information, and a present value of the count value of the time.

In a second aspect of the invention, to attain the second object, there is provided an automatic performance device comprising:

performance information memory means for storing automatic performance information;

reading means for sequentially reading out the automatic performance information from the performance information memory means, in predetermined sequence according to music contained in the automatic performance information;

condition memory means for storing information on at least one predetermined condition set for a time point of a head of each measure in the automatic performance information whenever the each measure is read out by the reading means, the condition memory means being capable of storing the information on the at least one predetermined condition for a plurality of measures in the automatic performance information;

rewinding instruction means for instructing rewinding of an automatic performance position within the automatic performance information; and rewinding means responsive to an instruction from the rewinding instruction means, for carrying out the rewinding of the automatic performance position measure by measure, by reading out the information on the at least one predetermined condition related to an immediately preceding measure in the automatic performance information whenever the rewinding is instructed by the rewinding instruction means.

Preferably, the information on the at least one predetermined condition set for the time point of the head of the each measure includes information on an address in the performance information memory means at which is stored a portion of the automatic performance information corresponding to timing of the head of the each measure.

Further preferably, the information on the at least one predetermined condition set for the time point of the head of the each measure includes at least one of information on tone color, information on effect, and information on tempo.

Also preferably, the rewinding instruction means includes a switch, the rewinding instruction means generating an instruction for the rewinding whenever the switch is operated, and generating an instruction for the rewinding whenever a predetermined time period elapses so long as the switch is continuously operated.

Preferably, the automatic performance device according to the invention further includes second rewinding means for carrying out rewinding of the position of the automatic performance in a manner other than the manner of rewinding by the first-mentioned rewinding means, and changeover means for changing the first-mentioned rewinding means over to the second rewinding means for carrying out rewinding of the automatic performance position when the rewinding instruction means instructs rewinding over a number of measures greater than a number of the information on the at least one predetermined condition stored in the condition memory means.

For example, the second rewinding means carries out rewinding of the automatic performance position by moving back the automatic performance position to a head of the automatic performance information, and then fast forwarding the automatic performance position to a location of a desired measure in the automatic performance information.

In a third aspect of the invention, to attain the third object, there is provided an automatic performance device comprising:

memory means for storing first automatic performance information containing measure line information, and second automatic performance information containing no measure line information, the first automatic performance information and the second automatic performance information each comprising time information and performance information;

selecting means for selecting one of the first automatic performance information and the second automatic performance information from the memory means;

detecting means for detecting whether automatic performance information selected by the selecting means is the first automatic performance information or the second automatic performance information;

reading means for reading out the performance information of the automatic performance information selected by the selecting means, based on the time information of the selected automatic performance information;

searching instruction means for instructing searching of a desired location in the selected automatic performance information; and searching means responsive to an instruction from the searching instruction means, for moving forward an automatic performance position measure along the selected automatic performance information measure by measure, by searching the measure line information contained in the first automatic performance information when selection of the first automatic performance information is detected by the detecting means, and by counting time corresponding to each measure in the second automatic performance information when selection of the second automatic performance is detected by the detecting means.

The above and other objects, features, and advantages of the invention will become more apparent from the following detailed description taken in conjunction with the accompanying drawings.

DETAILED DESCRIPTION

The invention will now be described in detail with reference to the drawings showing an embodiment thereof.

Figure 1:
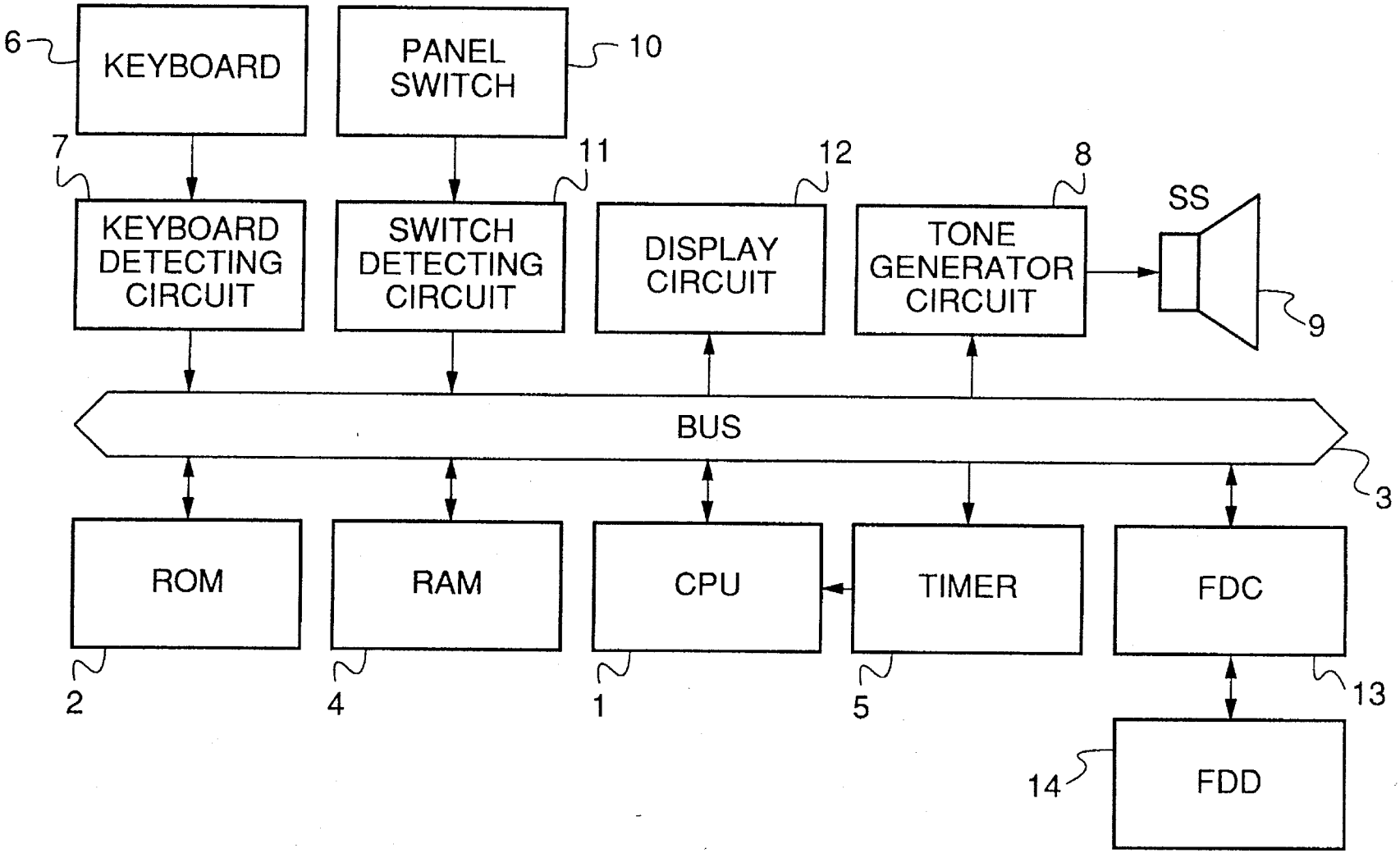
FIG. 1 is a block diagram showing the arrangement of hardware constituting an automatic performance device according to an embodiment of the invention.

Referring first to FIG. 1, there is schematically illustrated the arrangement of an automatic performance device according to an embodiment of the invention. In the figure, reference numeral 1 designates a central processing unit (CPU) which operates on programs stored in a ROM 2 to controls the operation of the whole automatic performance device. Connected to the CPU 1 via a bus 3 are various component parts. Specifically, the ROM 2 stores control programs according to which the CPU 1 performs various processings. A RAM 4 is provided with storage areas such as buffer areas, register areas, and flag areas for temporarily storing various data produced during processings executed by the CPU 1. The RAM 4 is also provided with a storage area for storing automatic performance data. A timer 5 supplies interrupt signals to the CPU 1, i.e. an interrupt signal generated with a variable period dependent upon the tempo at which automatic performance is given, and an interrupt signal generated with a fixed period irrespective of the tempo. The tempo-dependent period or time interval of generation of the first-mentioned interrupt signal corresponds to each of time intervals at which the signal is generated 24 times per quarter note, i.e. it corresponds to the time length of a ninety-sixth note. The CPU 1 operates in response to this interrupt signal, to execute a processing of reading automatic performance data stored in the RAM 4, thereby giving automatic performance at predetermined tempo.

A keyboard 6 is comprised of a plurality of (e.g. 61) keys, and various performance operating elements such as a pitch bend wheel and a modulation wheel. Operation of the keyboard 6 by the player is detected by a keyboard detecting circuit 7, which delivers keyboard operation information data to the CPU 1 via the bus 3. The CPU 1 operates in response to key operation information in the input keyboard operation information data to prepare note data such as note-on data and note-off data, and also prepare musical tone control data based on information on operation of performance operating elements including the pitch bend wheel in the input keyboard operation information data. The note data and the musical tone control data are delivered via the bus 3 to a tone generator circuit 8, which, in turn, forms a musical tone waveform signal based on the input note data and musical tone control data. The tone generator circuit 8 may be of the well-known waveform memory-reading type, or the FM type, or the physical model simulation type. The musical tone waveform signal formed by the tone generator circuit 8 is delivered to a sound system 9, whereby a musical tone is generated.

In FIG. 1, reference numeral 10 designates a panel switch which is comprised of various switches for selecting various functions including a start/stop switch (START/STOP) for starting and stopping automatic performance, a pause switch (PAUSE) for temporarily stopping automatic performance, a song select switch for selecting a song to be reproduced, a fast forward switch (FF), and a rewind switch (REW). Operations of these switches are detected by a switch detecting circuit 11, which delivers switch operation information data via the bus 3 to the CPU 1. The CPU 1 operates based on the input switch operation information to execute various functions designated thereby. Reference numeral 12 designates a display circuit for displaying various data, 13 a floppy disk controller (FDC) which operates in response to a command from the CPU 1 to control reading-out of automatic performance data from a floppy disk mounted in a floppy disk drive (FDD) 14 or writing of automatic performance data into the floppy disk. Automatic performance data read out from the floppy disk is stored into the RAM 4. The automatic performance device according to the invention is adapted to reproduce automatic performance data of a plurality of different kinds of formats which are supplied from the floppy disk.

Figure 2:
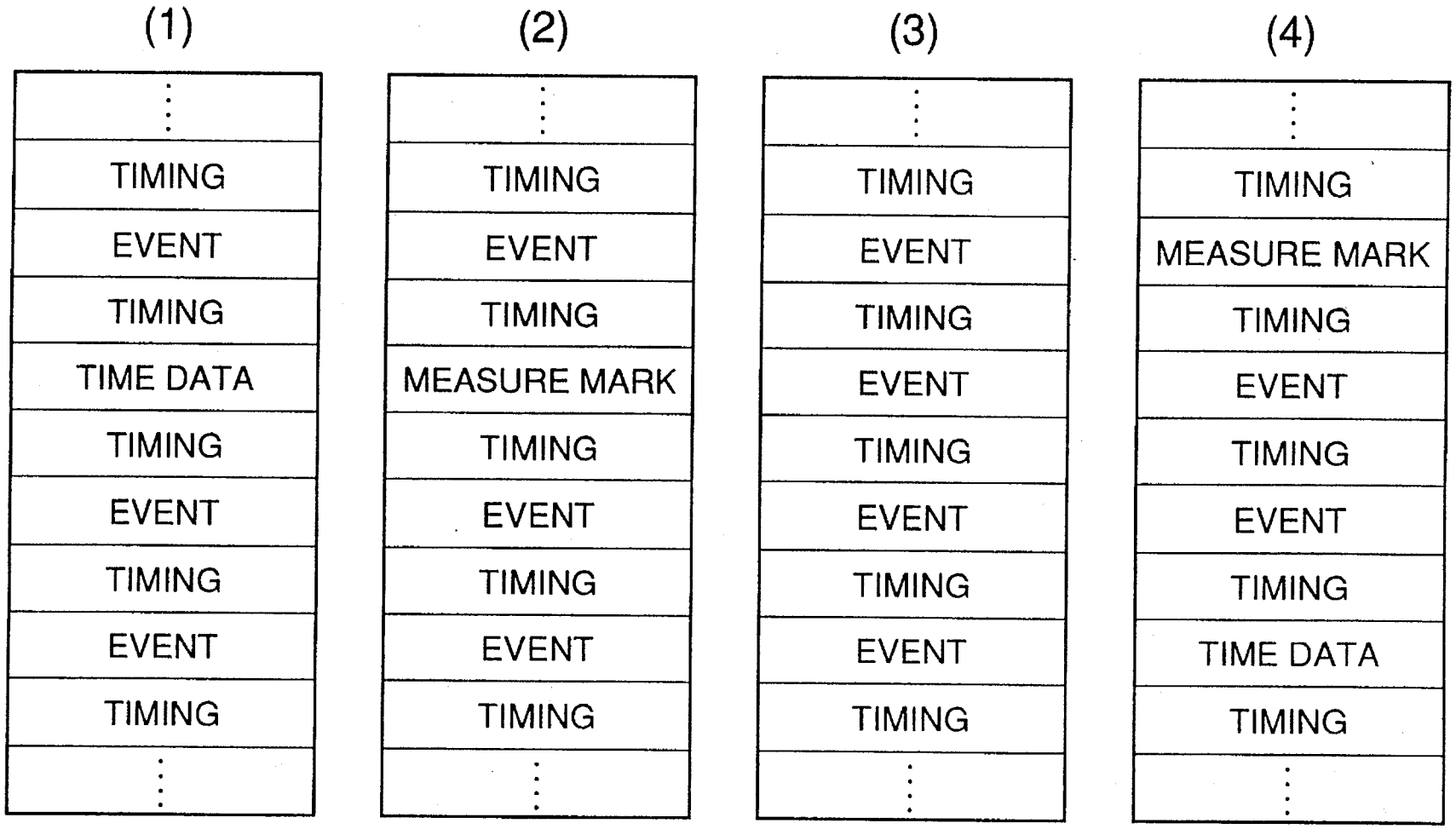
FIG. 2 is a schematic view showing formats of automatic performance information data.

FIG. 2 shows examples of formats of automatic performance data. (1) of FIG. 2 shows a first format of automatic performance data (hereinafter referred to as "the format (1)"), which is in accordance with Standard MIDI File (SMF) known as a common format for automatic performance data for electronic musical instruments. The format (1) of automatic performance data is essentially formed of event data related to performance, and timing data indicative of time interval of generation of each event data. The format (1) further contains time data indicative of a change in time, interposed between adjacent pieces of event data, to enable coping with a change in time during performance of a piece of music, as described in detail hereinafter.

(2), (3), and (4) of FIG. 2 respectively show second to fourth formats of automatic performance data (hereinafter referred to as "the format (2)", "the format (3)", and "the format (4)", respectively), which are different from the format (1), and specially provided for the automatic performance device according to the invention. Similarly to the format (1), these three formats (2) to (4) of automatic performance data are essentially formed of event data related to performance, and timing data indicative of time interval of generation of each event data. However, these formats (2) to (4) are different from the format (1) in the definition of data thereof, for example, in the kinds of information represented by respective bits of the data, as well as in the number of bytes constituting the data, and hence the automatic performance data of the format (1) and those of the formats (2) to (4) cannot be processed for reproduction thereof by the same or common processing program. Therefore, respective different processing programs are used for reproduction of data of these formats. The formats (2) to (4) are identical in format of data with each other but different in kind of data from each other. More specifically, the format (2) includes measure marks each indicative of the location of a measure line and provided at a location corresponding to timing of each measure, the format (3) does not include any measure, i.e. it is formed of timing data and event data alone, and the format (4) includes not only measure marks but also time data, like the format (1).

Further, the automatic performance data of each format contains format kind data, not shown, which is indicative of the kind of the format thereof, at a header area thereof, so that a processing program suitable for the format of automatic performance data to be reproduced is selected based on the format kind data, at the start of reproduction. The header areas of the formats (1), (2), and (4) also store time data indicative of the time of the song thereof.

Next, the outline of operation of the present embodiment will be described:

When the start/stop switch (STARTER/STOP) is operated during stoppage of the automatic performance device, automatic performance is started. When the pause switch (PAUSE) is operated during reproduction, the automatic performance is temporarily stopped. The fast forward switch (FF) functions differently between during reproduction and during temporary stoppage. That is, when it is operated during reproduction, it causes searching of a desired point of performance data by causing performance to be given at accelerated tempo to continue generation of musical tones. This searching is continued as long as the switch (FF) is continuously operated. On the other hand, when the fast forward switch is operated during temporary stoppage, it causes interruption of generation of musical tones and further causes the reading pointer to advance or move forward the point of performance data to be performed, measure by measure. More specifically, each time the fast forward switch is operated, the point of performance data to be performed is advanced by one measure. But, if the switch is continuously operated, i.e. held in pushed position, the above point is automatically advanced measure by measure at regular time intervals. The rewind switch (REW) functions in the same manner between during reproduction and during temporary stoppage. More specifically, each time the switch is operated, it causes the reading pointer to move backward the point of performance data to be performed, by one measure. But, if it is continuously operated, the above point is automatically moved backward measure by measure at regular time intervals. If the switch is operated during reproduction, it causes stopping generation of musical tones. If the start/stop switch is operated during reproduction or during temporary stoppage, the automatic performance is stopped.

Figure 3:
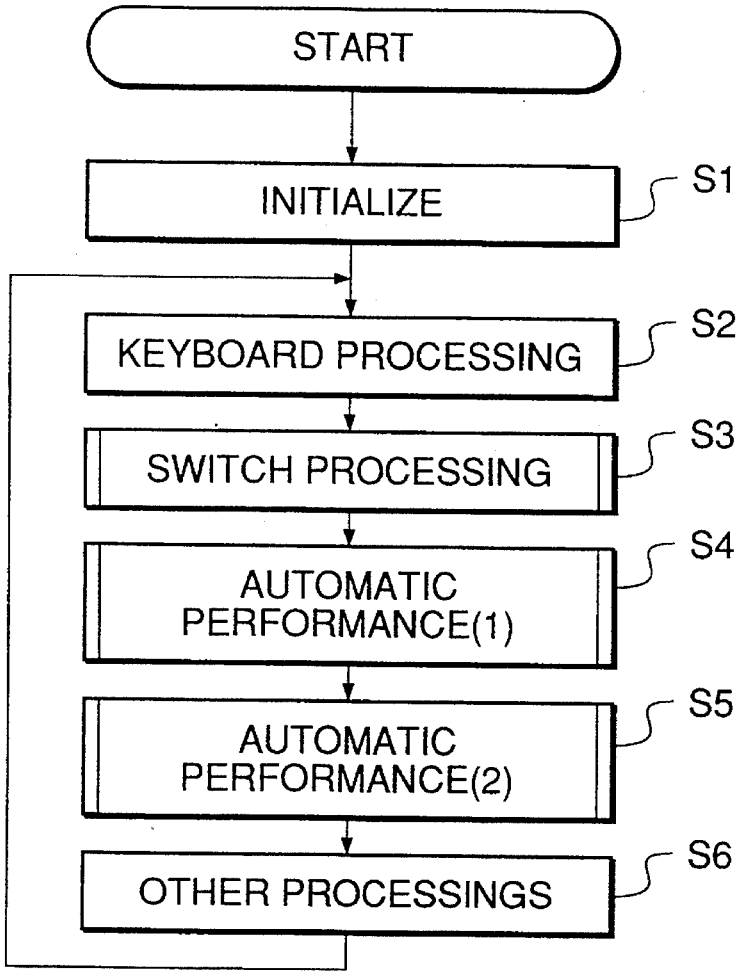
FIG. 3 is a flowchart showing a main routine for executing processings by a central processing unit (CPU)

The operation of the present embodiment which is carried out by the CPU 1 will now be described in detail with reference to FIG. 3 et seq.:

FIG. 3 shows a main routine for executing processings by the CPU 1. When a power switch, not shown, is closed, an initialization processing is carried out at a step S1, wherein various registers, flags, etc. are initialized. Then, at a step S2, a keyboard processing is executed, wherein a processing for generating musical tones is carried out, based on operation of the keyboard including operations of keys and performance operating elements. Then, at a step S3, a switch processing is carried out. Thereafter, an automatic performance processing (1) is carried out at a step S4, an automatic performance processing (2) at a step S5, and other processings at a step S6, respectively, followed by the program returning to the step S2. The steps S2 to S6 are repeatedly executed. The switch processing at the step S3 and the automatic performance processings at the steps S4 and S5 will be described in details, hereinafter.

Figure 4:
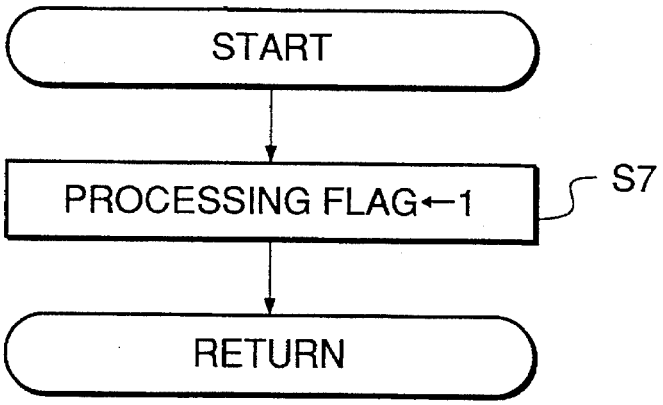
FIG. 4 is a flowchart showing a timer interrupt processing which is executed at tempo of automatic performance by the CPU.
Figure 5:
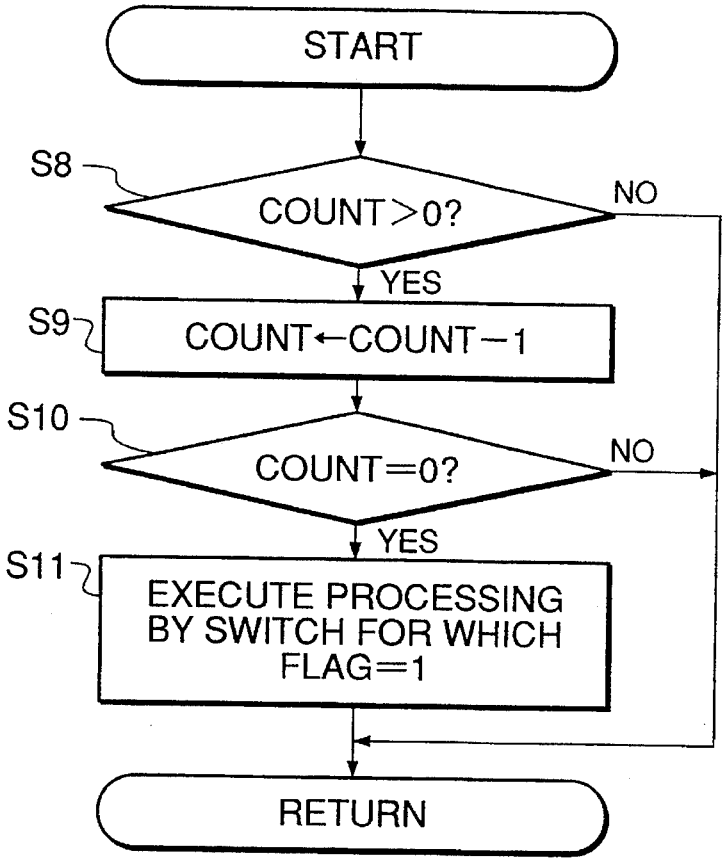
FIG. 5 is a flowchart showing another timer interrupt processing which is executed at regular time intervals of 10 ms by the CPU.

When an interrupt signal is supplied from the timer 5 to the CPU 1 during execution of the main routine of FIG. 3, the execution of the processing then being made by the main routine is interrupted, and then a timer interrupt processing is executed. The timer interrupt processing is effected with a selected one of two kinds of period, one being variable depending upon the tempo (equal to the time length of a ninety-sixth note), and the other being fixed (equal to time intervals of 10 ms). The variable period is used to maintain the tempo at which automatic performance is given. The fixed period is used for time control of auto repeat operation which is carried out when a switch is continuously operated. The auto repeat operation is identical with an operation carried out when the switch is repeatedly operated at regular time intervals. FIG. 4 shows a timer interrupt routine which is executed with the variable period dependent upon the tempo when this routine is started, a processing flag is set to 1 at a step S7. This flag indicates timing at which an automatic performance processing is to be executed during execution of the main routine. Specifically, when it is set to 1, an automatic performance processing is allowed to be executed when it is to be executed during execution of the main routine, whereas if it is set to a value other than 1, any automatic performance processing is inhibited during execution of the main routine. FIG. 5 shows a timer interrupt routine which is executed with the fixed period. When this routine is started, it is determined at a step S8 whether or not a count value of a counter COUNT exceeds 0. The counter COUNT counts time elapsed from the time a switch was operated or pushed, or time elapsed from the time a switch processing was executed on the last occasion while the switch was continuously operated. If the count value exceeds 0, the program proceeds to a step S9, wherein the count value of the counter COUNT is decremented by a value of 1, and then at a step S10 it is determined whether the resulting count value is equal to 0. If the answer is YES, a switch processing for which a flag assumes 1 is executed at a step S11, followed by the program returning to the main routine. The above flag is a flag which is set to 1 when the fast forward switch or the rewind switch is operated, though details of the flag will be described hereinafter. If the answer is NO at the step S8 or S10, the program returns to the main routine. In this way, whenever the count value of the counter COUNT becomes 0, a processing related to a switch then operated is executed. That is, when a switch is continuously operated, an operation is effected as if a switch-on event occurred at regular time intervals.

Figure 6:
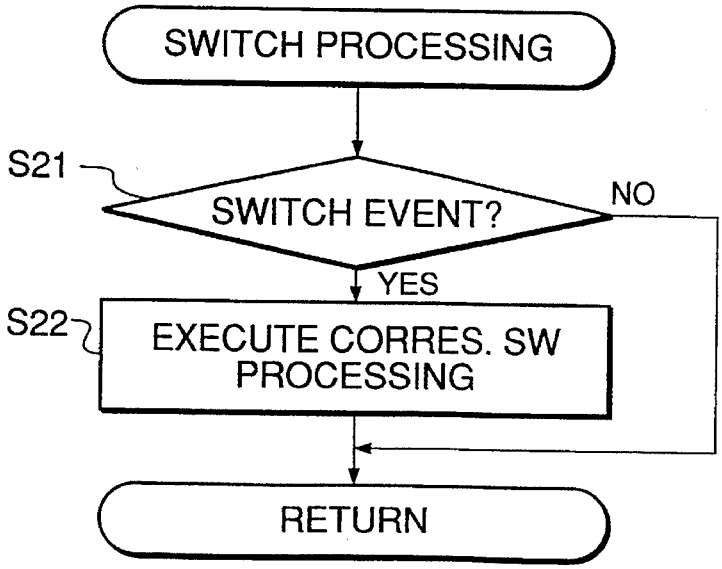
FIG. 6 is a flowchart showing a switch processing which is executed by the CPU.

FIG. 6 shows details of the switch processing executed at the step S3 in FIG. 3. It is determined at a step S21 whether or not there has occurred an ON event or an OFF event related to any switch. If there has occurred an ON event or an OFF event, a corresponding processing is carried out for the switch which has been closed or opened, at a step S22. Details of processings corresponding to respective switches will be described hereinafter with reference to FIGS. 7, 8, 15, 16, 21, 22, and 26.

Figure 7:
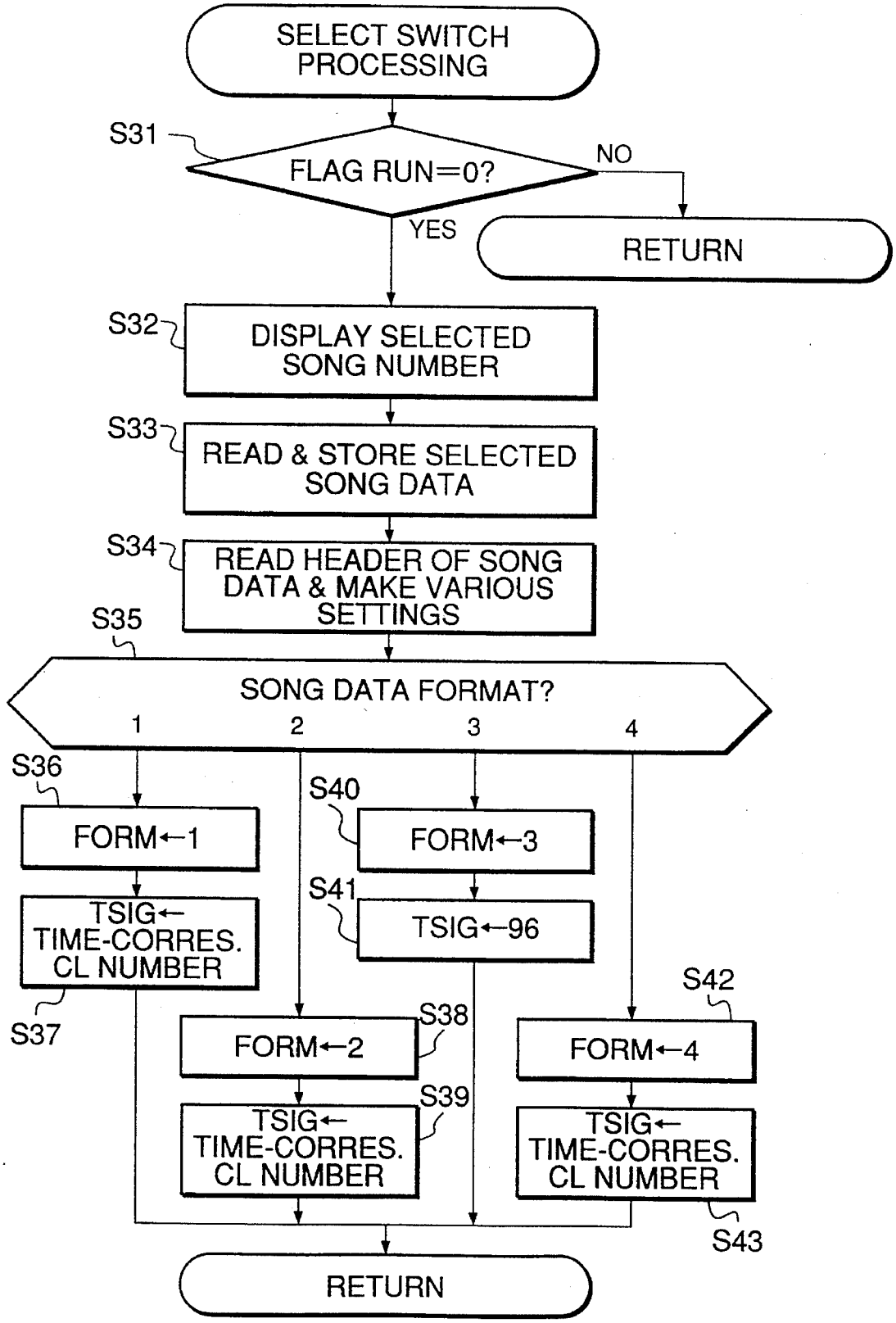
FIG. 7 is a flowchart showing a song-selecting switch processing executed by the switch processing of FIG. 6.

FIG. 7 shows a processing related to an ON event of a song select switch (SELECT), which is one of the processings corresponding to respective switches, executed at the step S22. The song select switch is formed by a plurality of updown switches. When any of the updown switches is closed, a song corresponding thereto is selected. When an ON event thus occurs, it is determined at a step S31 whether or not a flag RUN is equal to 0. If the answer is YES, the program proceeds to a step S32, wherein the number of the song selected is displayed by the display circuit 12. If the answer is NO, the program immediately returns to the main routine. The flag RUN indicates whether or not automatic performance is being given, such that when set to 1, it indicates that automatic performance is being given, inclusive of temporary stop. That is, selection of song can be made only when automatic performance is not being given.

Following the displaying of selected song, song data corresponding to the selected song is read out from a floppy disk mounted in the floppy disk drive (FDD) 14 and written into the RAM 4 at a song data storage area thereof, at a step S33. Then, at a step S34, data at a header area of the song data written into the RAM 4 is read out to effect various settings. At the next step S35, the format in which the song data is stored is determined from data related to the format of the song data read from the header area, and then depending upon the determined format, it is determined which of steps S36, S38, S40, and S42 the program should proceed to. If the determined format is the format (1) at (1) in FIG. 2, the program proceeds to the step S36, wherein a value of 1 is written into a format register FORM. Then, at a step S37, a time-corresponding clock number is determined from time data stored in the header area and loaded into a register TSIG which indicates the time length of one measure (corresponding to the time). The time-corresponding clock number indicates the number of clocks to which one measure in the song data corresponds. In the present embodiment, one clock corresponds to the time length of a ninety sixth note, and hence, for 4/4 time, the time-corresponding clock number is 96, and for 3/4 time, it is 72. If the determined format is the format (2), the program proceeds to the step S38, wherein a value of 2 is written into the format register FORM, followed by writing the time-corresponding clock number into the register TSIG at a step S39. If the determined format is the format (3) at (3) in FIG. 2, the program proceeds to the step S40, wherein a value of 3 is written into the format register FORM, followed by writing a value of 96 into the register TSIG at a step S41. The reason why the value of 96 is written into the register TSIG is that since no time data is stored in the format (3), the time is forcibly regarded as 4/4 time. If the determined format is the format (4), the program proceeds to the step S42, wherein a value of 4 is written into the format register FORM, followed by writing the time-corresponding clock number into the register TSIG at a step S43. In this way, initialization is carried out in a manner corresponding to the selected song.

Figure 8:
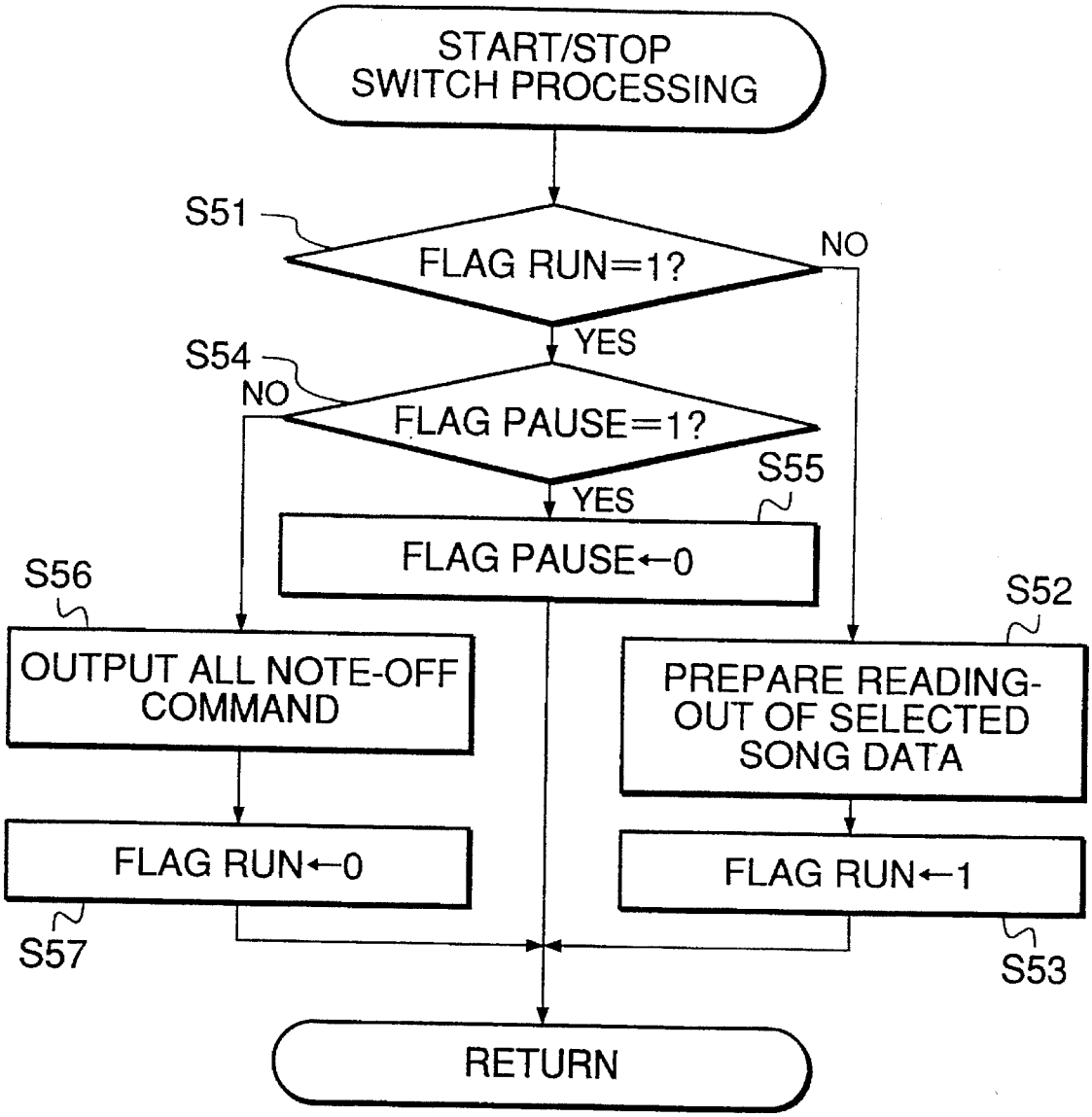
FIG. 8 is a flowchart showing a start/stop switch processing executed by the switch processing of FIG. 6.

Next, a start/stop processing will be described with reference to FIG. 8. When the start/stop switch is closed, it is determined at a step S51 whether or not the flag RUN assumes 1. If it assumes 1, the program proceeds to a step S54, whereas if it does not assume 1, the program proceeds to a step S52. At the start of the present routine, automatic performance is not being given, and accordingly the flag RUN does not assume 1, and hence the program proceeds to the step S52. At the step S52, preparation is made for reading out the selected song data. More specifically, the first timing data of the song data is read out and set into a register TIME, thus arranging for reproduction of the song data. Then, at a step S53, the flag RUN is set to 1 to thereby start automatic performance. On the other hand, if the start/stop switch becomes closed during automatic performance, the answer to the question of the step S51 becomes YES, and then the program proceeds to the step S54, wherein it is determined whether or not a flag PAUSE is equal to 1. If the answer is YES, the flag PAUSE is reset to 0 to thereby resume automatic performance, whereas if the answer is NO, the program proceeds to a step S56, wherein an all note-off command is issued to cause attenuation of a musical tone then being generated, and then the flag RUN is reset to 0 at a step S57, thereby stopping the automatic performance.

Figure 9:
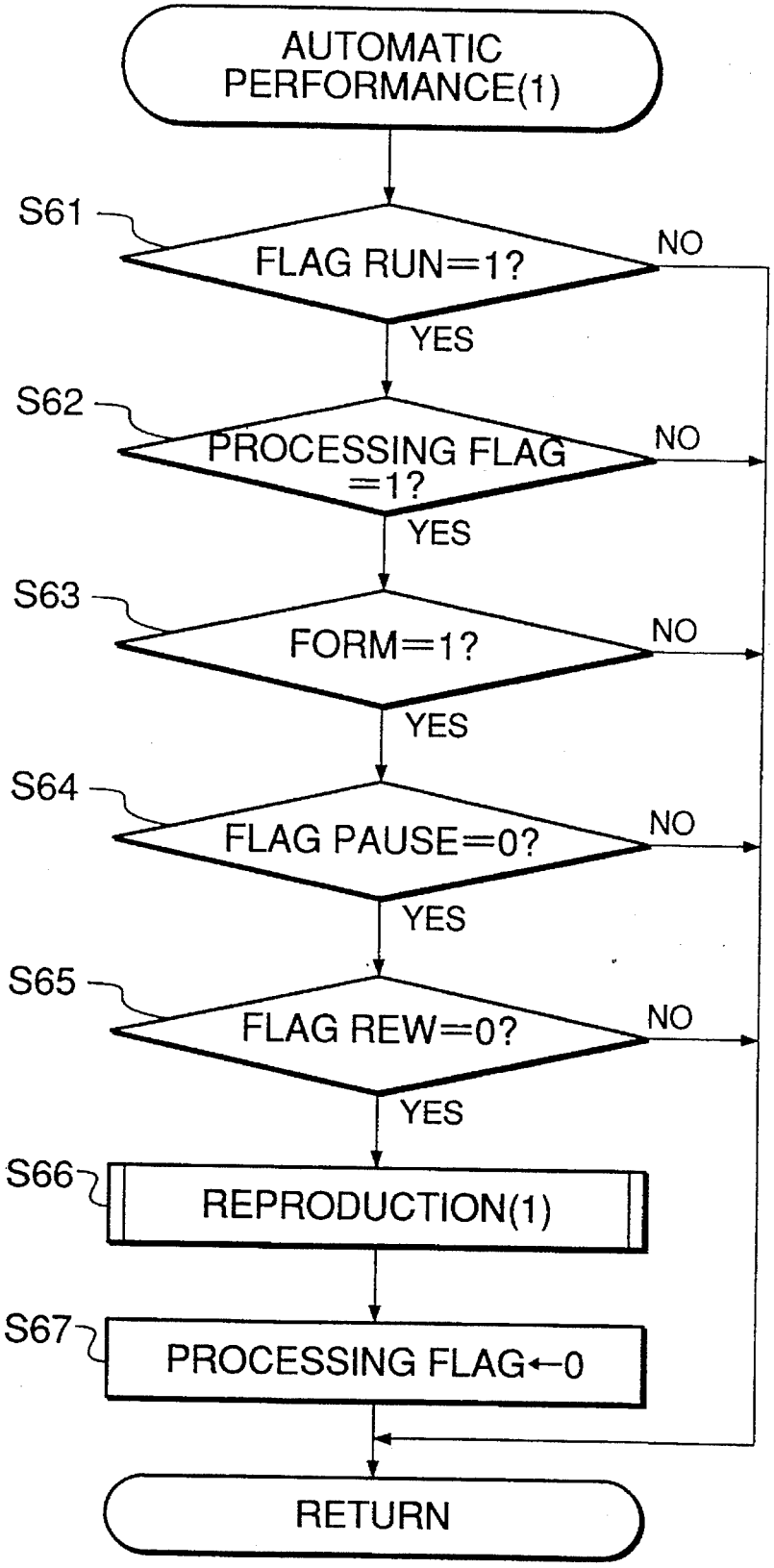
FIG. 9 is a flowchart showing an automatic performance processing (1) executed by the CPU

Next, details of the automatic performance processing (1) executed at the step S4 in FIG. 3 will be described with reference to FIG. 9. First, at a step S61, it is determined whether or not the flag RUN assumes 1. If it assumes 1, it is determined at a step S62 whether or not the processing flag assumes 1. If it assumes 1, it is determined at a step S63 whether or not the register FORM assumes 1. If it assumes 1, it is determined whether or not the flag PAUSE assumes 0. If it assumes 0, it is determined at a step S65 whether or not a flag REW assumes 0. If it assumes 0, the program proceeds to a step S66 for executing a reproduction processing (1). If the answer to any of the steps S61 to S65 is NO, the program immediately returns to the main routine without executing the reproduction processing (1). That is, the flag RUN=0 means that automatic performance is in stoppage. The processing flag=0 means that execution of automatic performance has not yet been instructed by the timer interrupt processing. The register FORM≠1 means that the selected song data has an automatic performance data format which cannot be processed by the automatic performance processing (1). The flag PAUSE=1 means that automatic performance is in temporary stoppage. The flag REW=1 means that rewinding is then being made. In these cases, reproduction is not intended to be made, and therefore the reproduction processing (1) at the step S66 is not executed. After execution of the reproduction processing (1) at the step S66, the processing flag is reset to 0 at a step S67.

Figure 10:
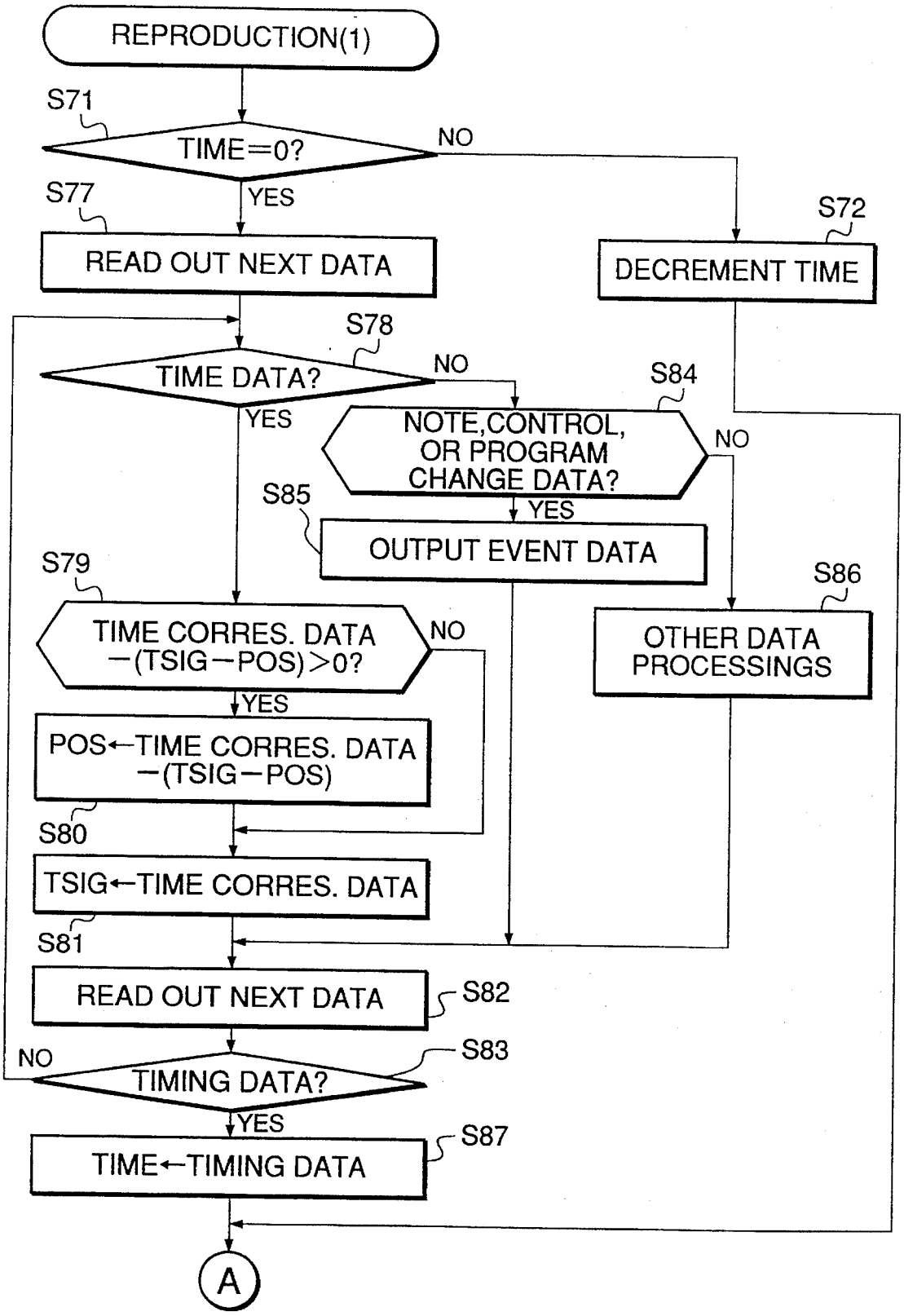
FIG. 10 is a flowchart showing a reproduction processing (1) executed by the automatic performance processing (1) of FIG. 9.
Figure 11:
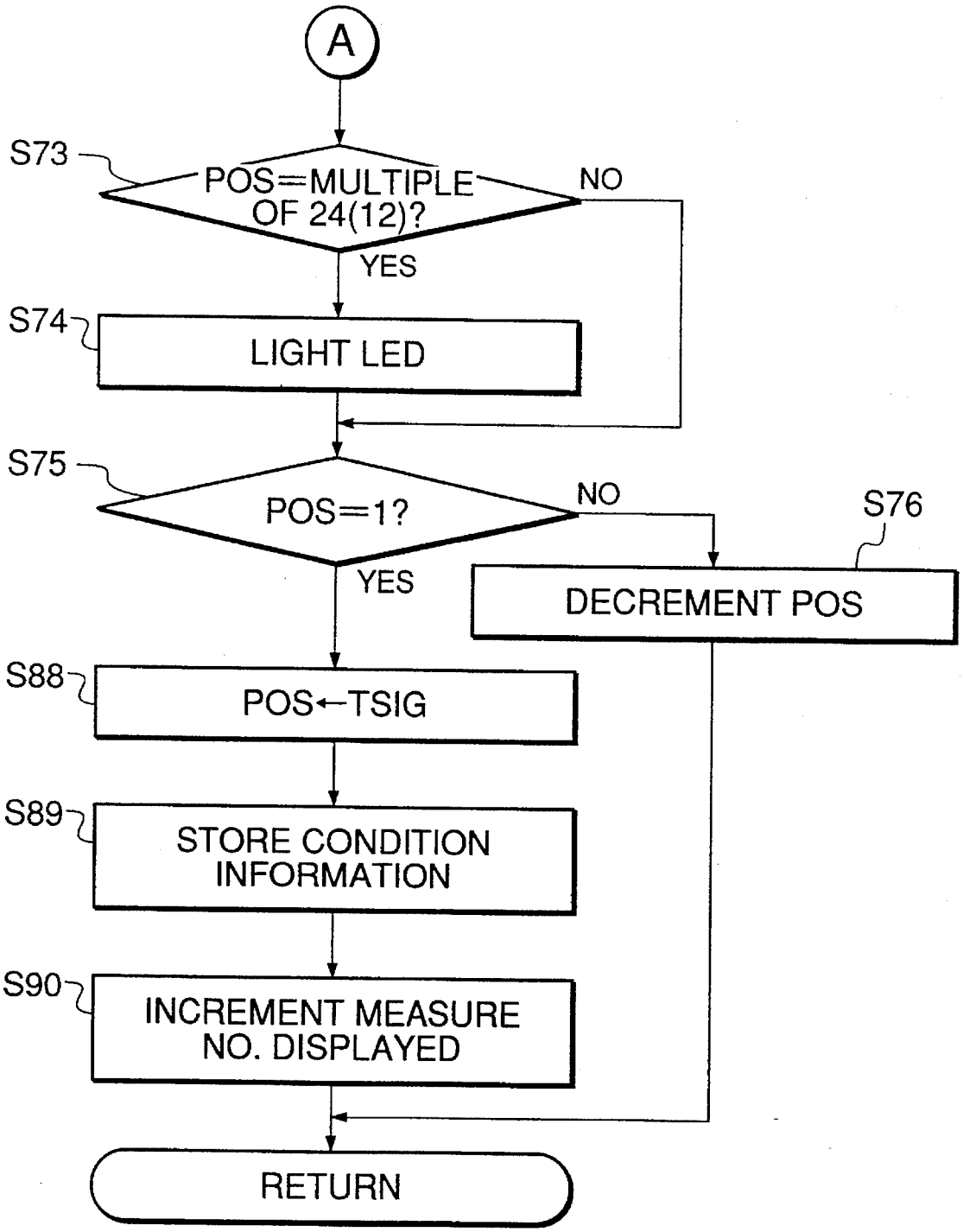
FIG. 11 is a flowchart showing a continued part of the reproduction processing (1)

Details of the reproduction processing (1) executed at the step S66 will now be described with reference to FIGS. 10 and 11. First, at a step S71, it is determined whether or not the register TIME assumes 0. If the answer is NO, that is, if the timing for reading out event data has not yet been reached, the program proceeds to a step S72 to make decrement of the value of the register TIME. Then, at a step S73, it is determined whether or not a register POS has a value as large as a multiple of 24 (or 12), i.e. whether beat timing has been reached. The register POS indicates the present position of the reading pointer within each measure. If the time of the song is simple quadruple time and the register POS assumes a multiple of 24, or if the time is simple octuple time and the register POS assumes a multiple of 12, the register POS value means that beat timing has been reached. If the answer to the question of the step S73 is YES, an LED is lighted for an instant to indicate that the beat timing has come, at a step S74. At the next step S75, it is determined whether or not the value of the register POS has reached 1. If it has not reached 1, the value of the register POS is decremented by a value of 1. When the answer to the question of the step S71 becomes YES after the above steps have been repeatedly executed, the program proceeds to a step S77 et seq. to read out event data. At the step S77, the next data or event data in the song data is read out, and at a step S78 whether the read-out data is time data. If it is time data, the program proceeds to a step S79 et seq. to change the setting of time of the song. At the step S79, it is determined whether or not the difference between the time-corresponding clock number (96 if the time is 4/4 time, and 72 if it is 3/4 time) and (TSIG-POS) is larger than 0. This step is provided to determine whether or not change of the time can be made within the measure. For example, to change over from 4/4 time to 3/4 time is inhibited when it is instructed after the last one beat, because the reading pointer has already passed the last timing for 3/4 time. If the answer to the question of the step S79 is YES, if the time can be changed, the register POS value is updated by setting the difference between a clock number corresponding to the read-out time and (TSIG-POS) into the register POS to thereby change the time during reproduction of the measure, at a step S80. At the next step S81, the time-corresponding clock number is written into the register TSIG. On the other hand, if the answer to the question of the step S79 is NO, the step S80 is skipped over so that change of the time will be made in the next measure or a subsequent one. In this way, change of the time is carried out in response to and based on time data read out.

Then, the program proceeds to a step S82 to read out the next data in the song data At a step S83, it is determined whether or not the read-out data is timing data. If it is timing data, the program proceeds to a step S87, whereas if it is not timing data, the program returns to the step S78. If the answer to the question of the step S83 is NO, it means that there exist a plurality of event data for one timing data. If the read-out data is not time data, the answer to the question of the step S78 is NO, and then the program proceeds to a step S84, wherein it is determined whether the read-out data is any of note data, control change data, or program change data, If the answer is YES, the event data is output to the tone generator circuit 8, thus carrying out generation and control of a musical tone. If the answer to the question of the step S84 is NO, a processing related to other data is carried out at a step S86. For example, if the read-out data is tempo change data, the value of the tempo changed is set into the timer 5 to thereby carry out a processing of changing the interruption period, etc. If the answer to the question of the step S83 is YES, the timing data is loaded into the register TIME at a step S87. When the value of the register POS becomes 1 after repeated execution of the above described steps over one measure, the answer to the question of the step S75 becomes YES. Then, at a step S88, the value of the register TSIG is set into the register POS, and then at a step S89 condition information on predetermined conditions including the position of the measure line in the present measure (the value of the register TIME, the address on the RAM at which is stored data in the song data corresponding to the timing of the measure head, etc.) and the present condition (set tone color, effect, tempo, etc.) is stored into a buffer. Then, the measure number to be displayed is incremented by a value of 1 at a step S90. The information stored in the buffer at the step S89 will be used in the rewind processing, hereinafter described. Information obtained over 20 measures up to the present time is scored in the buffer.

In the above described manner, automatic performance of song data of the format (1) at (1) of FIG. 2 is carried out.

Figure 12:
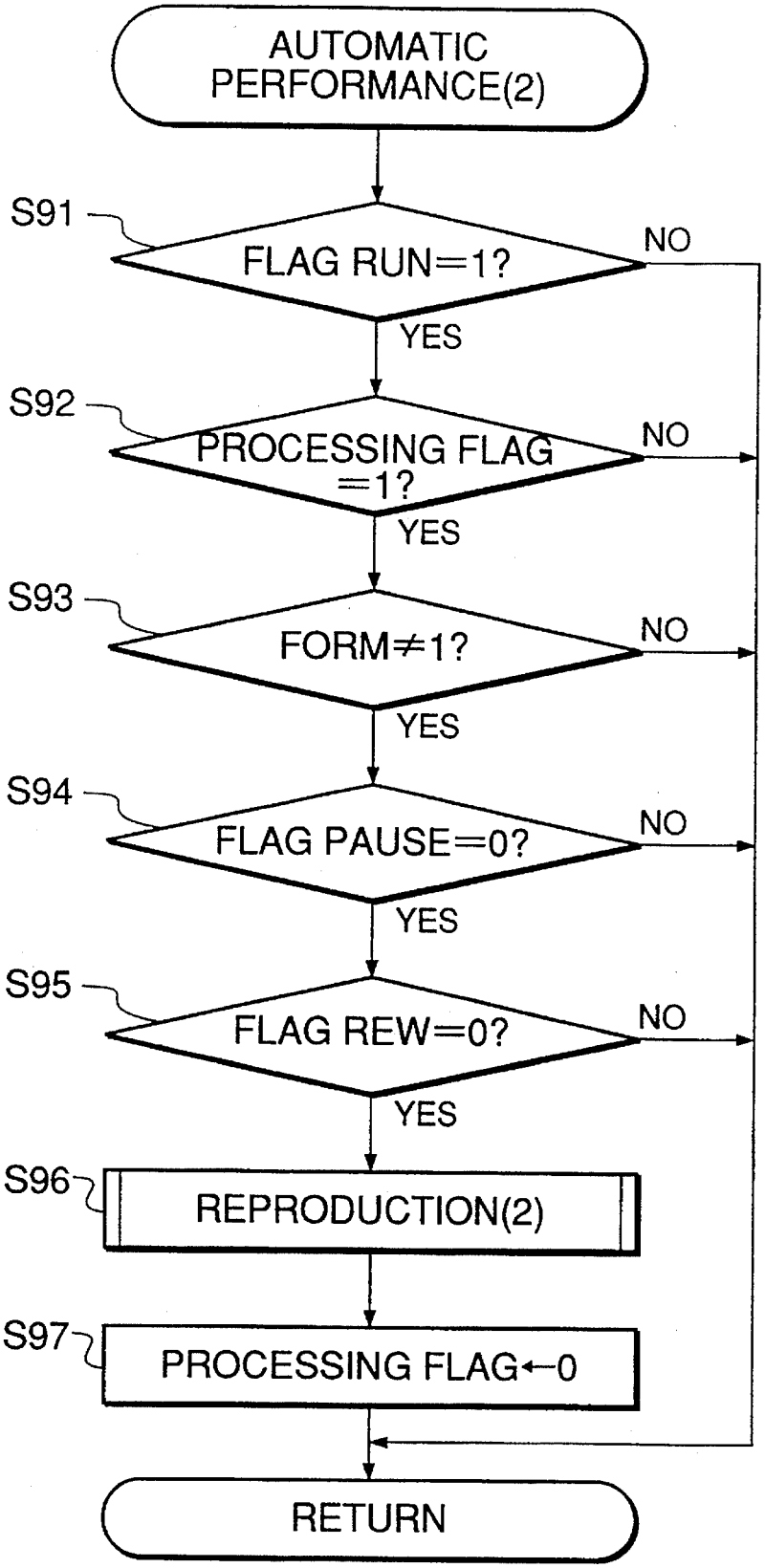
FIG. 12 is a flowchart showing an automatic performance processing (2) executed by the CPU.

Next, details of the automatic performance processing executed at the step S5 in FIG. 3 will be described with reference to FIG. 12. First, at a step S91, it is determined whether or not the flag RUN assumes 1. If the answer is YES, the program proceeds to a step S92, wherein it is determined whether or not the processing flag assumes 1. If the answer is YES, it is determined at a step S93 whether or not the register FORM assumes 1. If the answer is YES, it is determined at a step S94 whether or not the flag PAUSE assumes 0. If the answer is YES, it is determined at a step S95 whether or not the flag REW assumes 0. If the answer is YES, the program proceeds to a reproduction processing (2), hereinafter described. If any of the steps S91 to S95 provides a negative answer NO, the program immediately returns to the main routine without executing the reproduction processing (2). That is, the flag RUN=0 means that automatic performance is in stoppage. The processing flag=0 means that execution of automatic performance has not yet been instructed by the timer interrupt processing. The register FORM=1 means that the selected song data has an automatic performance data format which cannot be processed by the automatic performance processing (2). The flag PAUSE=1 means that automatic performance is in temporary stoppage. The flag REW=1 means that rewinding is then being made. In these cases, reproduction is not intended to be made, and therefore the reproduction processing (2) at the step S96 is not executed. After execution of the reproduction processing (2) at the step S96, the processing flag is reset to 0 at a step S97.

Figure 13:
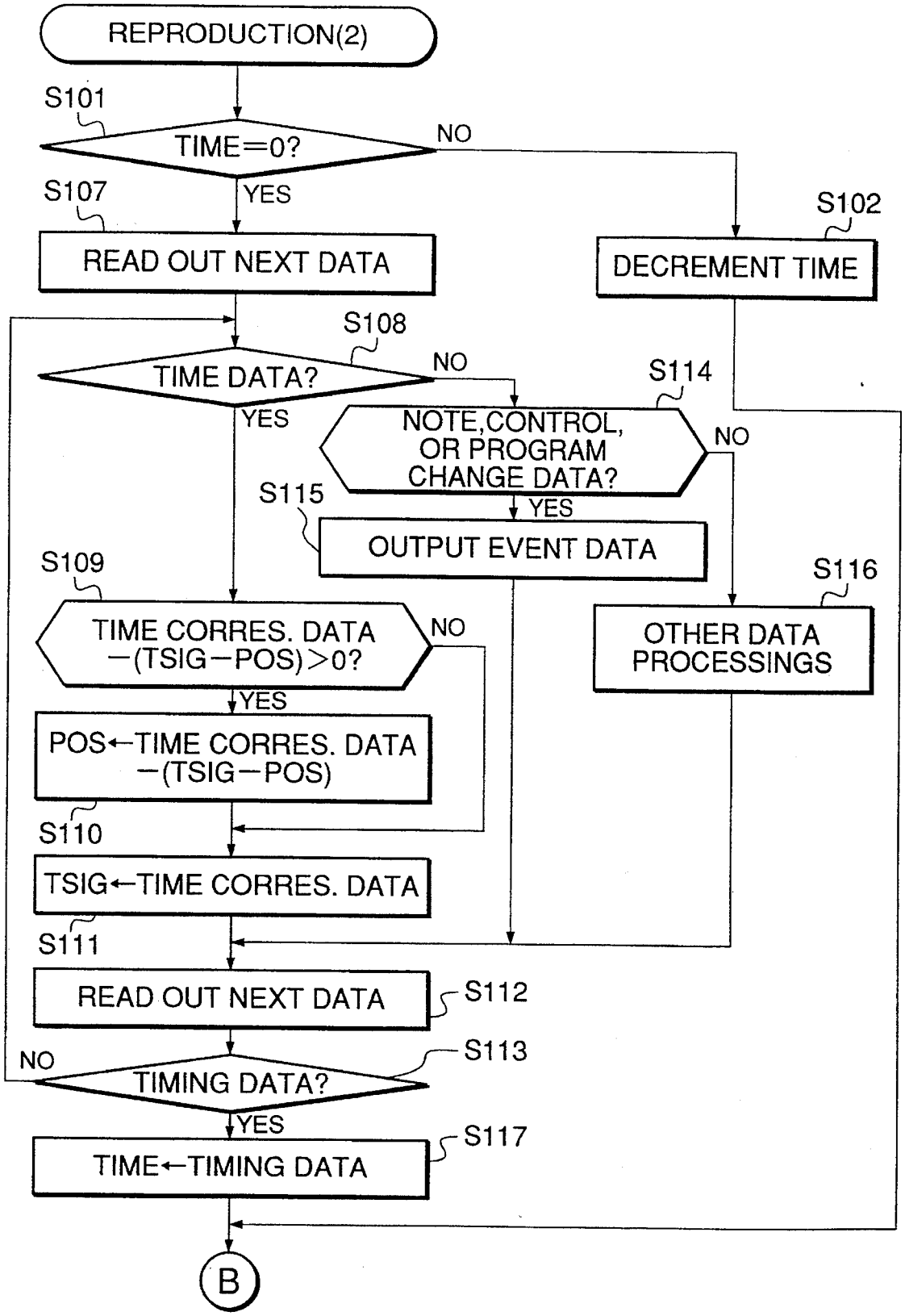
FIG. 13 is a flowchart showing a reproduction processing (2) executed by the automatic performance processing (2) of FIG. 12.
Figure 14:
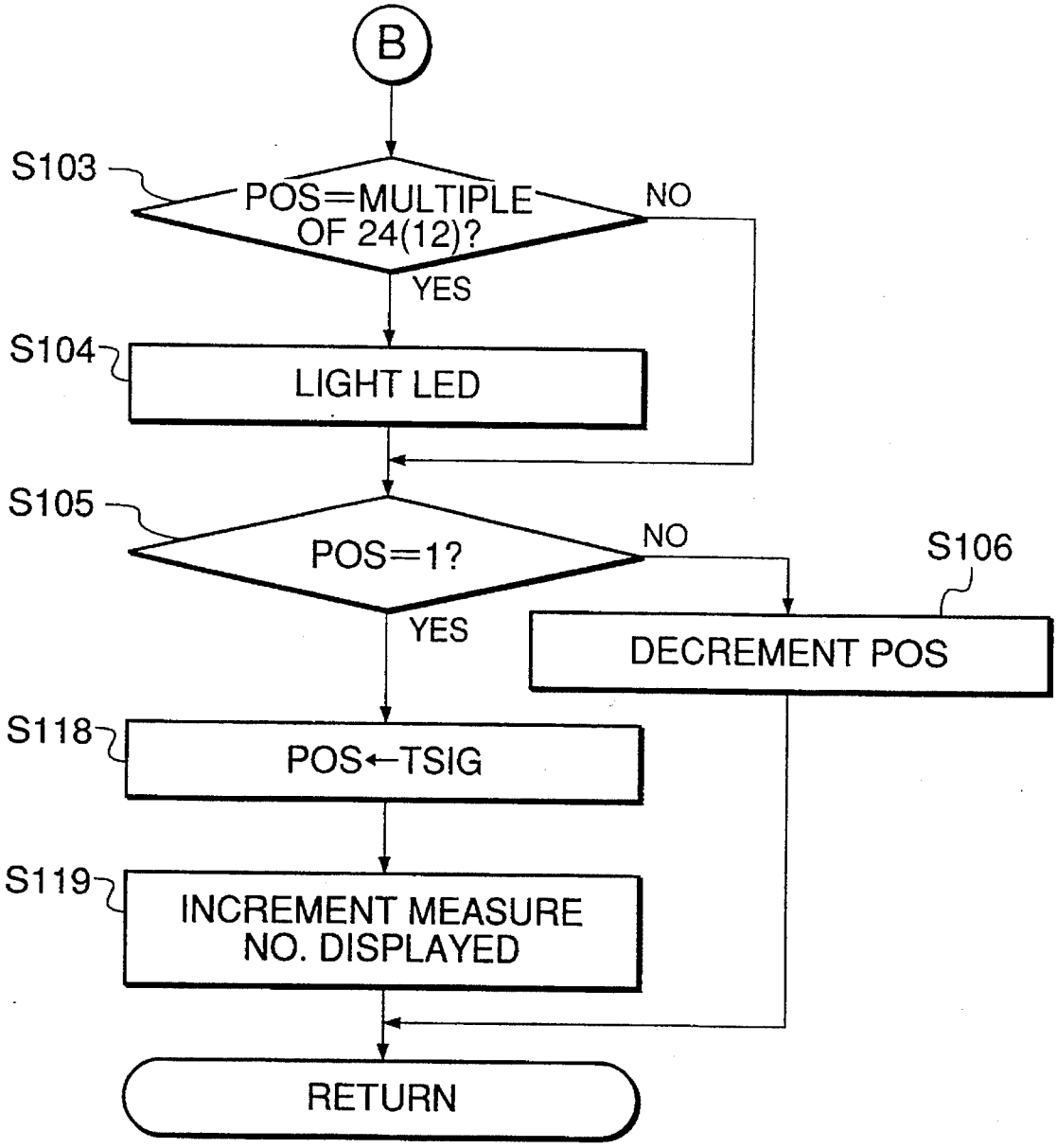
FIG. 14 is a flowchart showing a continued part of the reproduction processing (2)

Details of the reproduction processing (2) executed at the step S96 will now be described with reference to FIGS. 13 and 14. First, at a step S101, it is determined whether or not the register TIME assumes 0. If the answer is NO, that is, if the timing for reading out event data has not yet been reached, the program proceeds to a step S102 to make decrement of the value of the register TIME. Then, at a step S103, the register POS has a value as large as a multiple of 24 (or 12), i.e. whether beat timing has been reached. The register POS indicates the present position of the reading pointer within each measure. If the time of the song is simple quadruple time and the register POS assumes a multiple of 24, or if the time is simple octuple time and the register POS assumes a multiple of 12, the register POS value means that beat timing has been reached. If the answer to the question of the step S103 is YES, the LED is lighted for an instant to indicate that the beat timing has come, at a step S104. At the next step S105, it is determined whether or not the value of the register POS has reached 1. If it has not reached 1, the value of the register POS is decremented by 1. When the answer to the question of the step S101 becomes YES after the above steps have been repeatedly executed, the program proceeds to a step S107 et seq. to read out event data. At the step S107, the next data or event data in the song data is read out, and at a step S108 it is determined whether or not the read-out data is time data. If it is time data, the program proceeds to a step S109 et seq. to change the setting of time of the song. At the step S109, it is determined whether or not the difference between the time-corresponding clock number (96 if the time is 4/4 time, and 72 if it is 3/4 time) and (TSIG-POS) is larger than 0. This step is provided to determine whether or not the change of the time can be made within the measure. For example, to change over from 4/4 time to 3/4 time is inhibited when it is instructed after the last one beat, because the reading pointer has already passed the last timing for 3/4 time. If the answer to the question of the step S109 is YES, the register POS value is updated by setting the difference between a clock number corresponding to the read-out time and (TSIG-POS) into the register POS to thereby change the time during reproduction of the measure, at a step S110. At the next step S111, the time-corresponding clock number is written into the register TSIG. On the other hand, if the answer to the question of the step S109 is NO, the step S110 is skipped over so that change of the time will be made in the next measure or a subsequent one. In this way, change of the time is carried out in response to time data read out.

Then, the program proceeds to a step S112 to read out the next data in the song data. At a step S113, it is determined whether or not the read-out data is timing data. If it is timing data, the program proceeds to a step S117, whereas if it is not timing data, the program returns to the step S108. If the answer to the question of the step S113 is NO, it means that there exist a plurality of event data at one timing. If the read-out data is not time data, the answer to the question of the step S108 is NO, and then the program proceeds to a step S114, wherein it is determined whether the read-out data is any of note data, control change data, or program change data, If the answer is YES, the event data is output to the tone generator circuit 8, thus carrying out generation and control of a musical tone. If the answer to the question of the step S114 is NO, a processing related to other data is carried out at a step S116. For example, if the read-out data is tempo change data, the value of the tempo changed is set into the timer 5 to thereby carry out a processing of changing the interruption period, etc. If the answer to the question of the step S113 is YES, the timing data is loaded into the register TIME at a step S117. After repeated execution of the above described steps over one measure, the value of the register POS becomes 1, and then the answer to the question of the step S105 becomes YES. Then, at a step S118, the value of the register TSIG is set into the register POS, and then at a step S119 the measure number to be displayed is incremented by a value of 1.

In the above described manner, automatic performance of song data of the format (2), (3), or (4) at (2), (3), or (4) of FIG. 2 is carried out.

The automatic performance processing (2) is distinguished from the automatic performance processing (1) in that while in the automatic performance processing (1)

reproduction (reproduction processing (1)) is carried out when the register FORM indicative of the format of the song data assumes 1 (step S63), in the automatic performance processing (2) reproduction (reproduction processing (2)) is not carried out when the register FORM assumes 1 (step S93), and in the automatic performance processing (1) the present condition information is stored at the timing of a measure line (step S89), whereas in the automatic performance processing (2) it is not stored. Further, the two automatic performance processings are different from each other in the manner of interpretation of data due to the difference in the format of song data to be processed. However, the difference in the manner of interpretation of data does not appear in the above given description of the flowcharts nor in the drawings.

Figure 15:
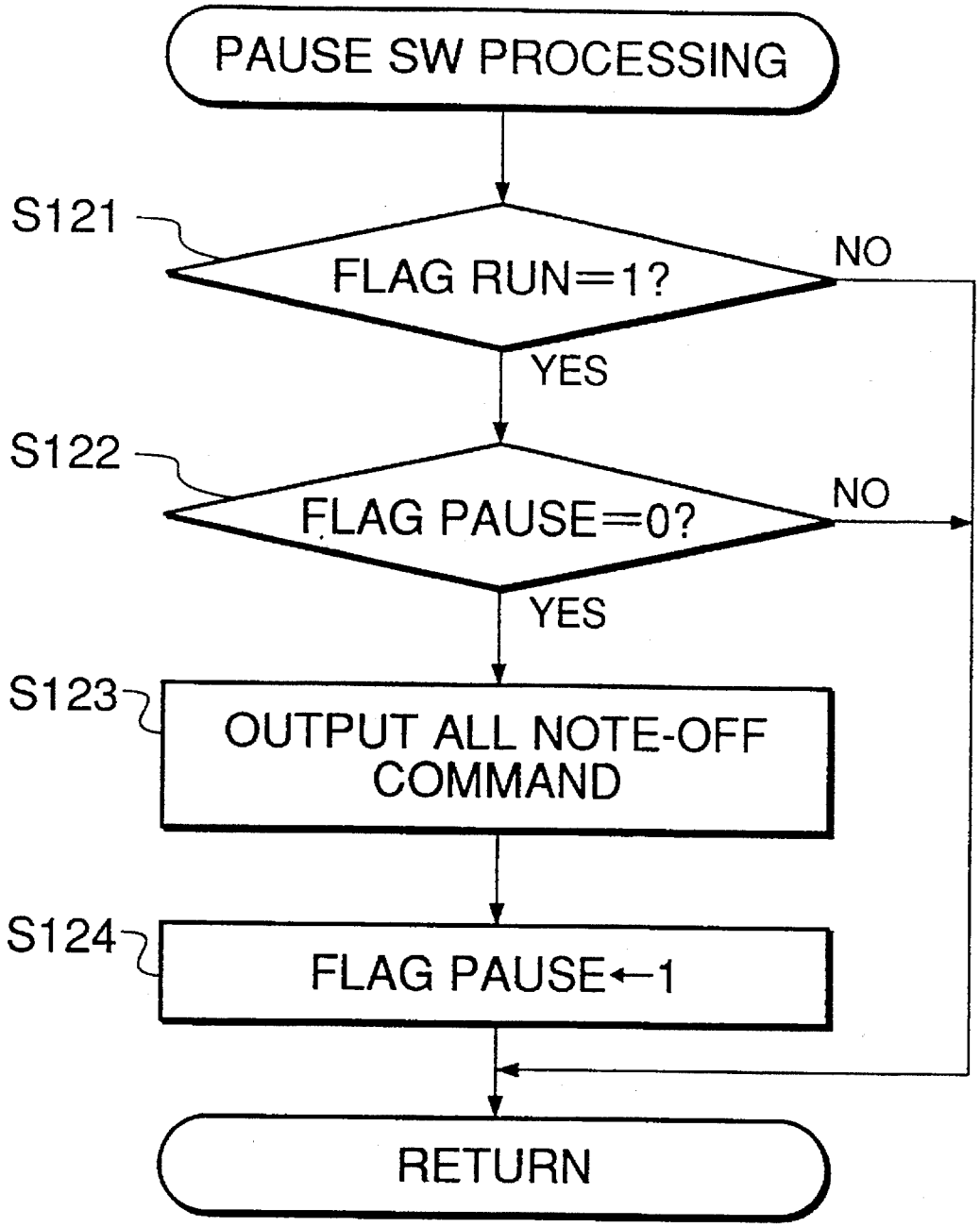
FIG. 15 is a flowchart showing a pause switch processing executed by the switch processing of FIG. 6.

Details of a pause switch processing will now be described with reference to FIG. 15. First, at a step S121, it is determined whether or not the flag RUN assumes 1. If it assumes 1, it is determined at a step S122 whether or not the flag PAUSE assumes 0. If the answer is YES, the program proceeds to a step S123, wherein the all note-off command is issued to the tone generator circuit 8 to attenuate a musical tone then being generated, followed by executing a step S124 to set the flag PAUSE to 1. In this way, generation of song date can be temporarily stopped. If the answer to the question of the step S121 or the step S122 is NO, the program immediately returns to the main routine.

Then, a fast forward (FF) switch-on processing will be described in detail with reference to FIG. 16. First, at a step S131, it is determined whether or not the flag RUN assumes 1. If the answer is NO, the program immediately returns to the main routine, whereas if the answer is YES, the program proceeds to a step S132, wherein it is determined whether or not the flag PAUSE assumes 1. If the answer is NO, the value of the tempo then assumed is temporarily put aside at a step S133, and the tempo value is set to 300, i.e. to a velocity value such that 300 quarter notes are reproduced per minute, thus changing the period of interruption by the timer 5. By thus setting the interruption period, automatic performance proceeds at the velocity corresponding to the tempo value of 300 if the fast forward switch is pushed while the pause switch is not operated, thus carrying out fast forwarding. Since only the tempo value is changed, musical tones continue to be generated even during the fast forwarding. At a step S135 following the step S134, a flag FF is set to 1 to indicate that the fast forward switch has been operated, and then at a step S135, the flag REW, which indicates that the rewind switch has been operated when set to 1, is reset to 0. Consequently, if the fast forward switch is pushed while the rewind switch is in operative or pushed position, only the fast forward switch, which is thus pushed later than the rewind switch, effectively functions. Then, at a step S136, a value of 80 is set into the counter COUNT. As previously stated with respect to the timer interrupt processing of FIG. 5, this counter COUNT is provided to detect continuous operation of the switch. That is, when the switch is pushed, the counter value is set to 80, and then the counter value is decremented by a value of 1 whenever 10 ms elapses so long as the switch is held in the pushed position, and when the counter value is decreased to 0, a processing is carried out, which is similar to a processing carried out when the switch is pushed. In other words, whenever pushing of the switch is continued for 0.8 sec, a processing similar to the switch-on processing is carried out. However, the steps S133, S134, and S135 are executed only at the first pushing of the switch.

On the other hand, when the answer to the question of the step S132 is YES, the program proceeds to a step S137, wherein it is determined which value the register FORM assumes, in other words, which format the song data in reproduction is stored in. Depending upon results of this determination, the program branches to steps S138, S139, S140, or S141.

Figure 16:
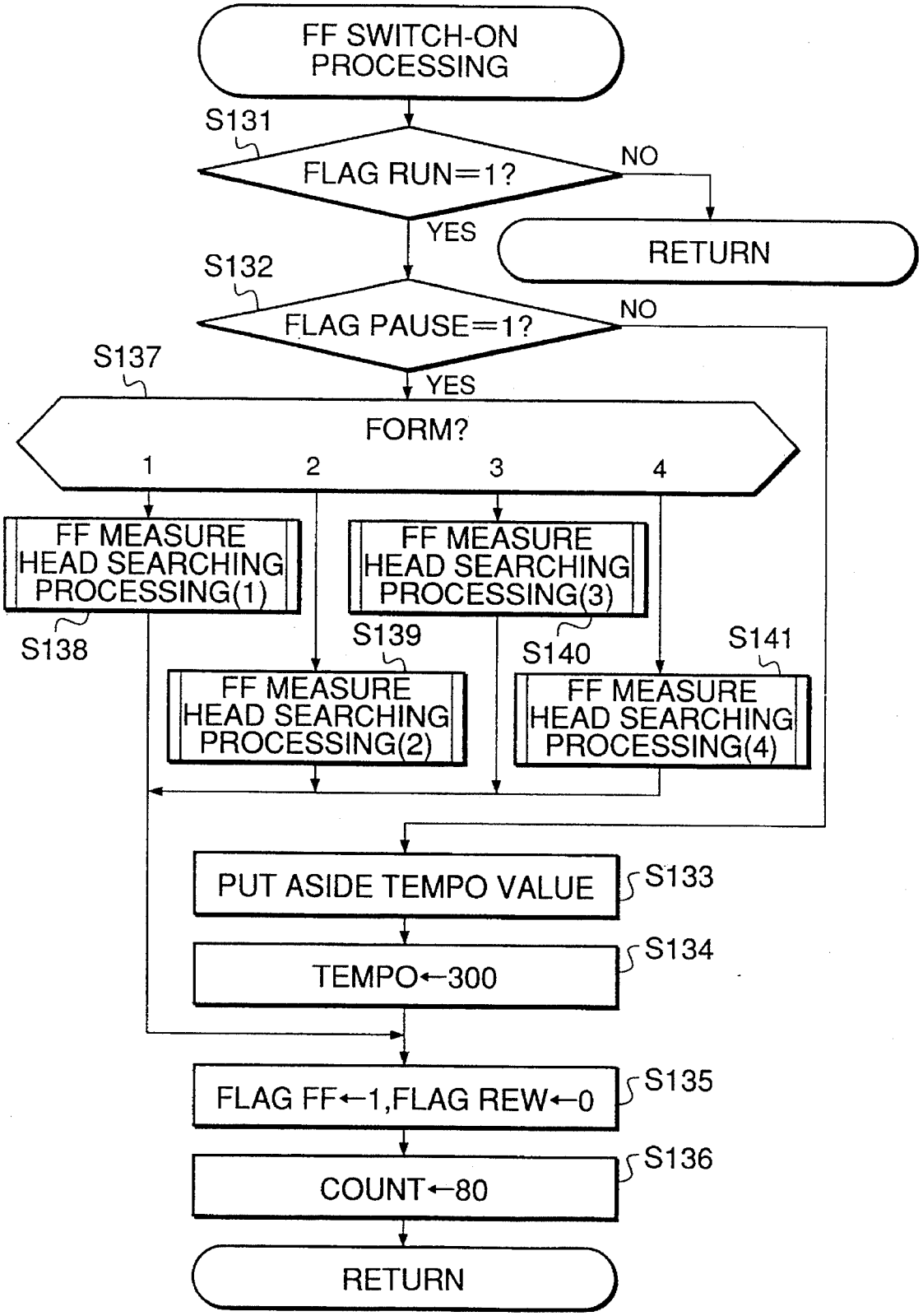
FIG. 16 is a flowchart showing a fast forward (FF) switch-on processing executed by the switch processing of FIG. 6.
Figure 17:
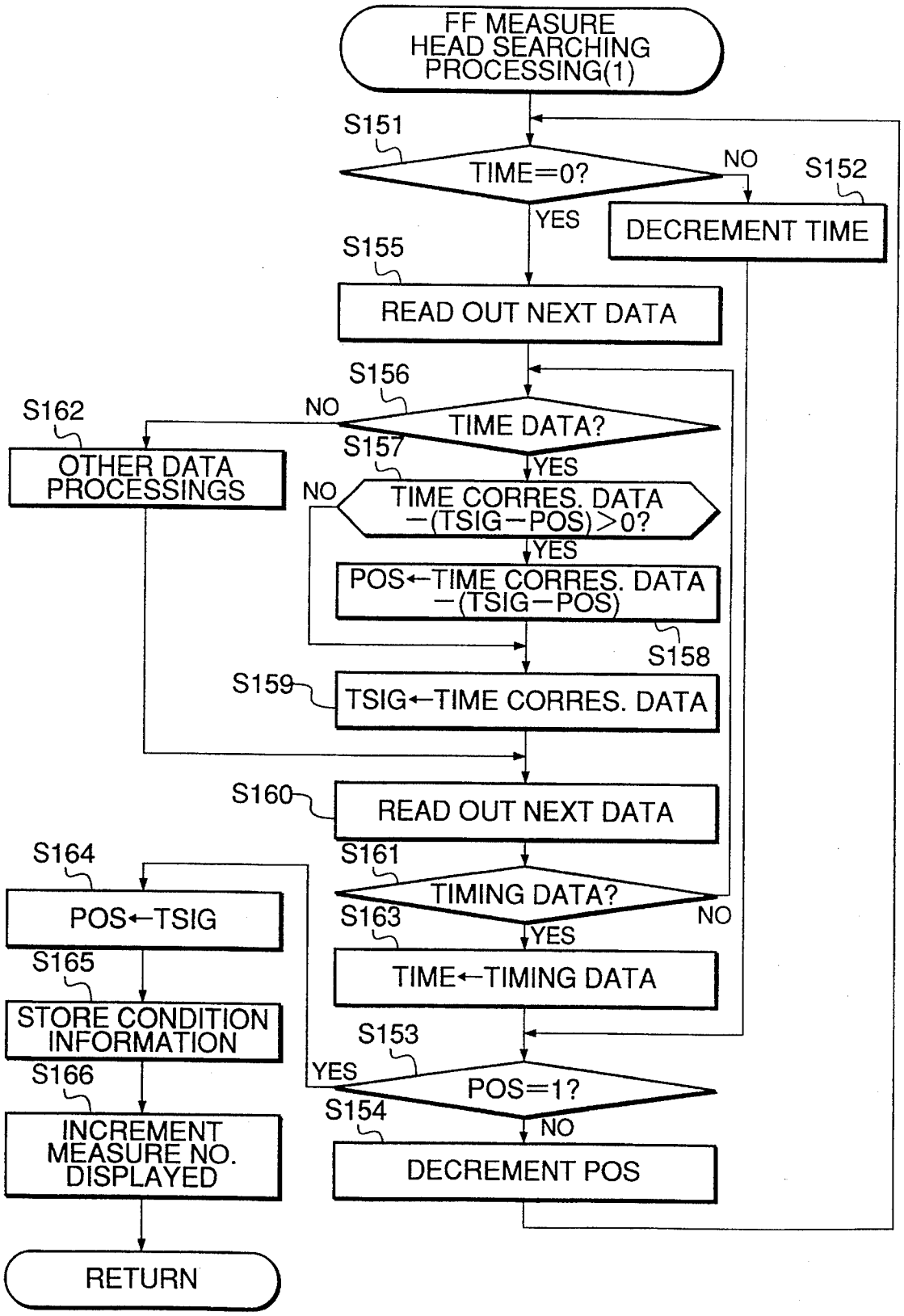
FIG. 17 is a flowchart showing an FF measure head-searching processing (1) executed by the fast forward switch-on processing of FIG. 16.

FIG. 17 shows details of an FF measure head-searching processing, which is executed at the step S138 in FIG. 16. This processing is similar to the reproduction processing (1) of FIGS. 10 and 11, but the former is mainly distinguished from the latter in that musical tones are not generated, the processing is effected at a high speed irrespective of whether the timer interrupt processing is carried out, and the processing is terminated at a time point processing of one measure is completed. First, at a step S151 it is determined whether or not the register TIME assumes 0. If the answer is NO, the program proceeds to a step S152, wherein the value of the register TIME is decremented by a value of 1. Then, at a step S153, it is determined whether or not the value of the register Pos has reached 1. If it has not yet reached 1, the register POS value is decremented by a value of 1. Then, the program returns to the step S151, to repeatedly execute the above processing. When the answer to the question of the step S151 is YES, the next data in the song data, i.e. event data is read out at a step S155, followed by determining at a step S156 whether or not the read-out data is timing data. If it is timing data, it is determined at a step S157 whether or not the difference between the time-corresponding clock number (96 if the time is 4/4 time, and 72 if the time is 3/4 time) and (TSIG-POS) is larger than 0. If the answer is YES, the difference between a clock number corresponding to the read-out time and (TSIG-POS) is substituted into the register POS, at a step S158, thus updating the value of the register POS indicative of the present position of the reading pointer. Then, at a step S159, the time-corresponding clock number is written into the register TSIG. If the answer to the step S157 is NO, the step S158 is skipped over, but the program proceeds to a step S160 to read out the next data in the song data. Then, at a step S161 it is determined whether or not the read-out data is timing data. If it is timing data, the program proceeds to a step S163, whereas if it is not timing data, the program returns to the step S156. If the read-out data is not timing data, the answer to the question of the step S156 becomes NO, and then the program proceeds to a step S162, wherein other processings such as changing of tone color and changing of tempo are carried out. When the value of the register POS becomes 1 after repeated execution of the above described processings, the answer to the question of the step S153 becomes YES. Then, at a step S164, the value of the register TSIG is set into the register POS, and then at a step S165 condition information on predetermined conditions including the position of the measure line in the present measure (the value of the register TIME, the address on the RAM at which is stored data in the song data corresponding to the timing of the measure head, etc.) and the present condition (set tone color, effect, tempo, etc.) is stored into a buffer. Then, at a step S166 the measure number to be displayed is incremented by 1, thereby completing the FF measure head-searching processing. In the above described manner, song data of the format (1) is processed by one measure whenever the fast forward switch is pushed or whenever pushing of the switch is continued for 0.8 sec. Even when there occurs a change in the time while the measure is being processed by the fast forwarding, the reading pointer does never stop at a point other than the measure head.

Figure 18:
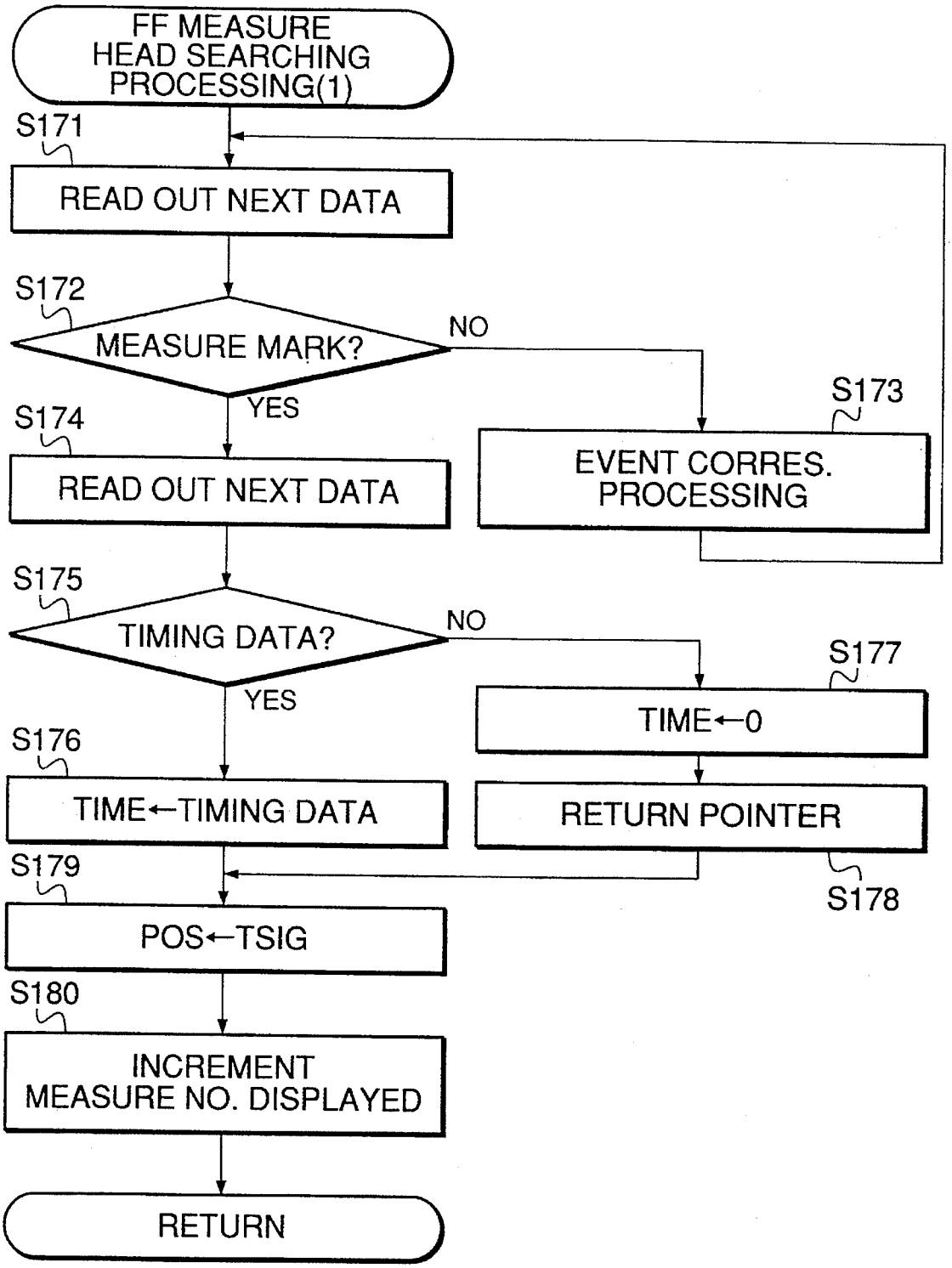
FIG. 18 is a flowchart showing an FF measure head-searching processing (2) executed by the fast forward switch-on processing of FIG. 16.

FIG. 18 shows details of the FF measure head-searching processing (2) executed at the step S139 in FIG. 16. First, at a step S171, data next to the data just processed in song data is read out. At a step S172, it is determined whether or not the read-out data is a measure mark. If the answer is NO, a processing corresponding to the event of the event data read out (e.g. tone color change processing) is carried out, followed by the program returning to the step S171. This procedure is repeatedly executed until the answer to the question of the step S172 becomes YES, and then at a step S174 the next data is read out. At a step S175, it is determined whether or not the read-out data is timing data. If the answer is YES, the value of the timing data read out is stored into the register TIME at a step S176, whereas if the answer is NO, 0 is stored into the register TIME, followed by moving back the reading pointer by one, i.e. to the immediately preceding position at a step S178. These steps S177 and S178 are executed when there exists event data at the same timing as a measure mark, i.e. at the head of a measure. At the step S177, the register TIME value is set to 0 in order to read out data in the next measure. At the step S178, the reading pointer is moved back by one, because the first event data in the next measure has already been read out. Then, at a step S179, the value of the register TISG is stored into the register POS, and then at a step S180 the measure number to be displayed is incremented by 1, thereby completing the FF measure head-searching processing (2). According to the FF measure head-searching processing (2) described above, fast-forward searching of song data of the format (2) can be achieved at a high speed by searching only measure marks.

Figure 19:
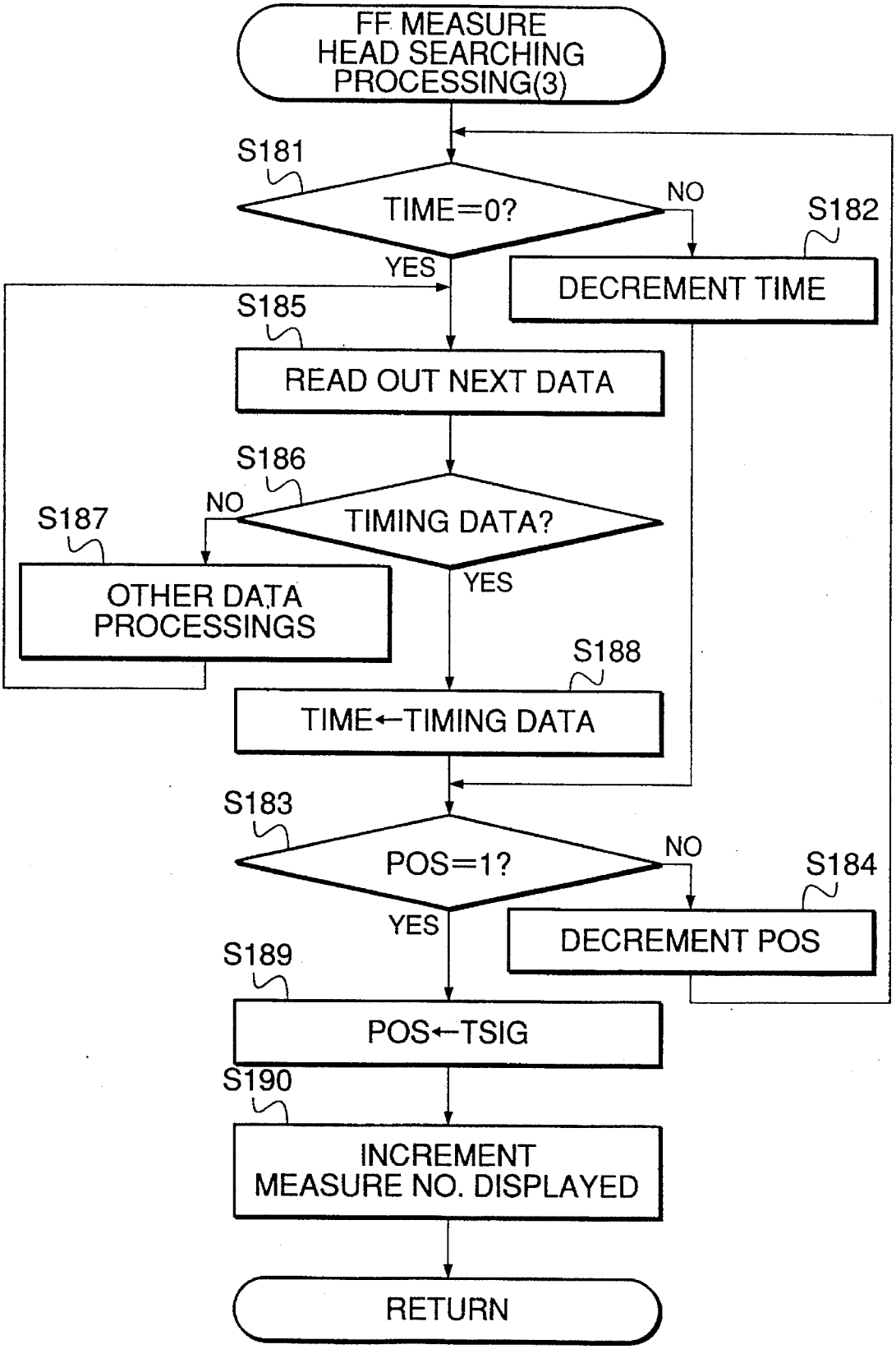
FIG. 19 is a flowchart showing an FF measure head-searching processing (3) executed by the fast forward switch-on processing of FIG. 16.

FIG. 19 shows details of the FF measure head-searching processing (3) executed at the step S140 in FIG. 16. First, at a step S181, it is determined whether or not the value of the register TIME is 0. If the answer is NO, the value of the register TIME is decremented by 1 at a step S182. Then, at a step S183 it is determined whether or not the value of the register POS is 1. If the answer is NO, the value of the register POS is decremented by 1 at a step S184, followed by the program returning to the step S181. When the answer to the question of the step S181 becomes YES, the program proceeds to a step S185, wherein the next data is read out. Then, at a step S186, it is determined whether or not the read-out data is timing data. If the answer is NO, the program proceeds to a step S187, wherein other data processings are carried out, whereas if the answer is YES, the program proceeds to a step S188, wherein the value of the timing data is stored into the register TIME. When the answer to the question of the step S183 becomes YES after repeated execution of the above procedure, the program proceeds to a step S189, wherein the value of the register TISG is stored into the register POS, and at a step S190 the measure number to be displayed is incremented by 1, followed by terminating the present FF measure head-searching processing (3). According to the present processing, fast-forward searching of song data of the format (3) can be realized by advancing the reading pointer along song data until the value of the register POS becomes 1, since the song data contains neither any measure mark nor time changing data.

Figure 20:
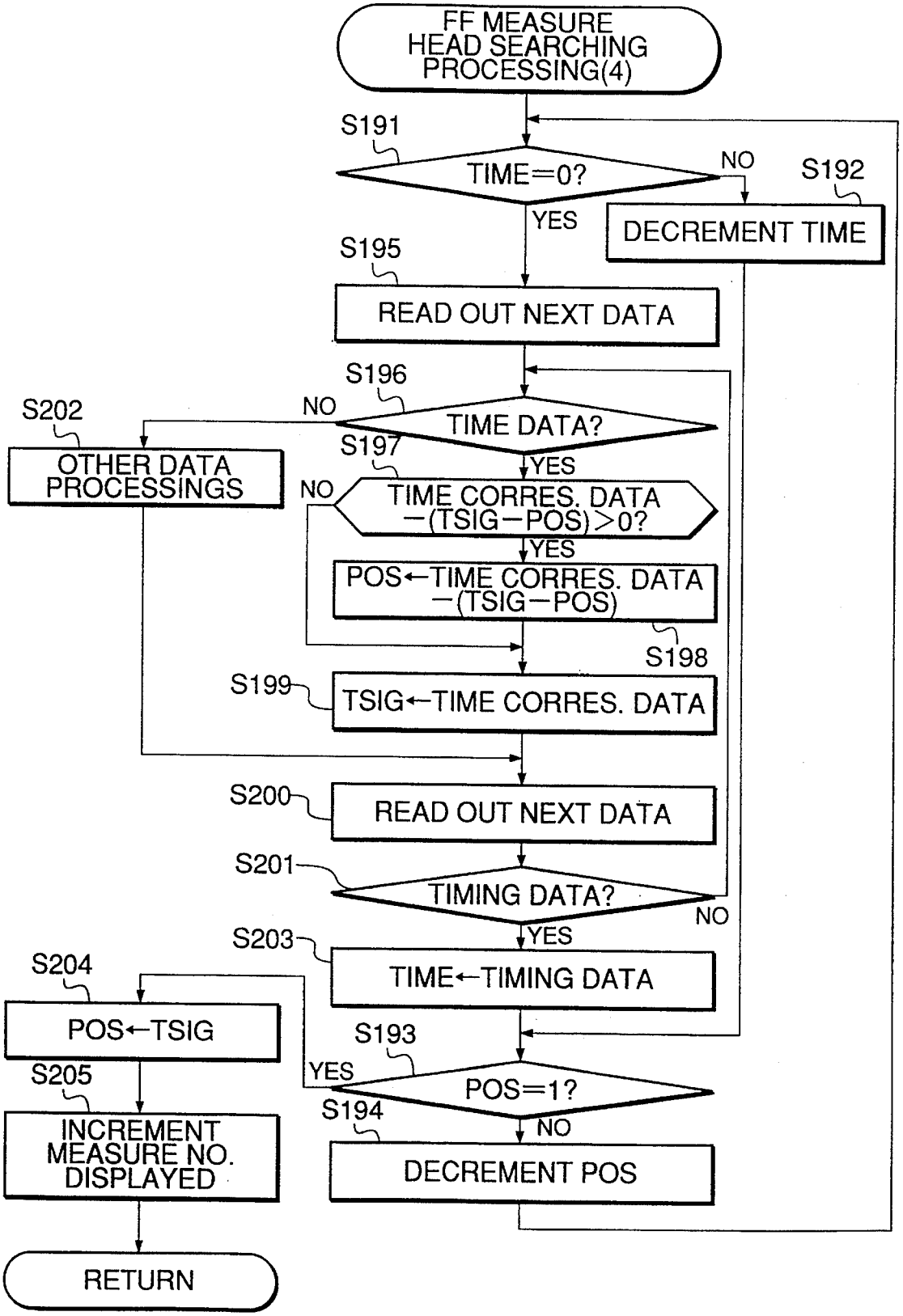
FIG. 20 is a flowchart showing an FF measure head-searching processing (4) executed by the fast forward switch-on processing of FIG. 16.

FIG. 20 shows details of the FF measure head-searching processing (4) executed at the step S141 in FIG. 16. This processing is similar to the reproduction processing (2) of FIGS. 13 and 14, but the former is mainly distinguished from the latter in that musical tones are not generated, the processing is effected at a high speed irrespective of whether the timer interrupt processing is carried out, and the processing is terminated at a time point processing of one measure is completed. First, at a step S191, it is determined whether or not the register TIME assumes 0. If the answer is NO, the program proceeds to a step S192 to make decrement of the value of the register TIME. Then, at a step S193, it is determined whether or not the register POS values has reached 1. If it has not reached 1, the value of the register POS is decremented by 1 at a step S194, followed by the program returning to the step S191 to repeatedly execute the above steps. When the answer to the question of the step S191 becomes YES, the program proceeds to a step S195, wherein the next data or event data in the song data is read out, and at a step S196 it is determined whether the readout data is time data. If it is time data, the program proceeds to a step S197, wherein it is determined whether or not the difference between the time-corresponding clock number (96 if the time is 4/4 time, and 72; if it is 3/4 time) and (TSIG-POS) is larger than 0. If the answer to the question is YES, the register POS value is updated by setting the difference between a clock number corresponding to the read-out time and (TSIG-POS) into the register POS, at a step S198. At the next step S199, the time-corresponding clock number is written into the register TSIG. On the other hand, if the answer to the question of the step S197 is NO, the step S198 is skipped over. Then, the program proceeds to a step S200 to read out the next data in the song data. At the next step S201, it is determined whether or not the read-out data is timing data. If it is timing data, the program proceeds to a step S203, whereas if it is not timing data, the program returns to the step S196. If the read-out data is not time data, the answer to the question of the step S196 is NO, and then the program proceeds to a step S202, wherein processings related to other data are carried out, such as tone color changing and tempo changing. When the value of the register POS becomes 1 after repeated execution of the above procedure, the answer to the question of the step S193 becomes YES. Then, at a step S204, the value of the register TSIG is set into the register POS, and then at a step S205 the measure number to be displayed is incremented by 1, thereby completing the FF measure head-searching processing. In the above described manner, fast-forward searching of song data of the format (4) is carried out. Although song data of the format (4) also contains measure marks, the location of a measure head is determined based on time data without searching a measure mark, thereby enabling accurate detection of the location of a measure head even when the stored location of a measure mark deviates from the actual location of the measure head.

Figure 21:
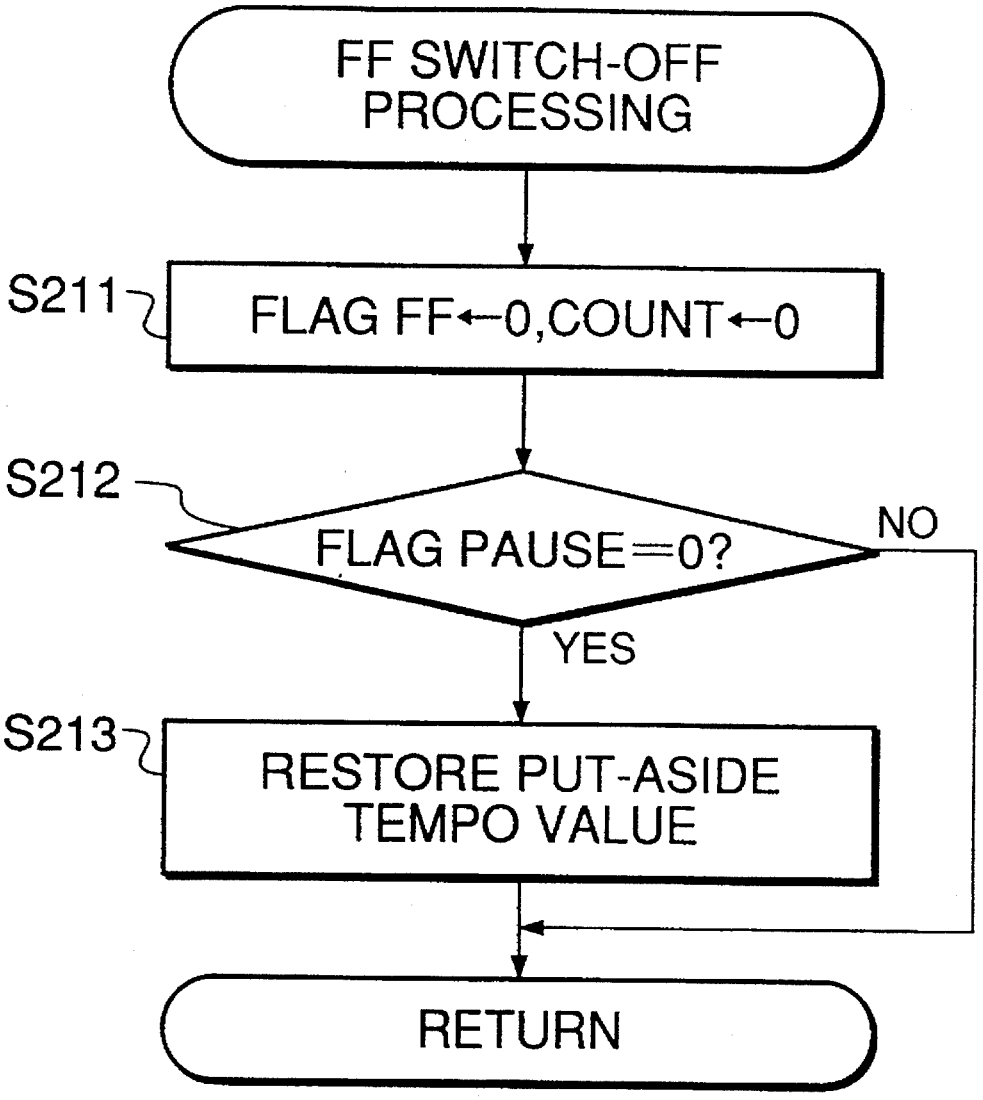
FIG. 21 is a flowchart showing a fast forward switch-off processing executed by the switch processing of FIG. 6.

FIG. 21 shows a fast forward switch-off processing. First, at a step S211, the counter COUNT is reset to 0. By this resetting, in the timer interrupt processing continued pushing of the switch is no more detected. Then, at a step S212, it is determined whether or not the flag PAUSE assumes 0. If the answer is YES, the value of the tempo is restored to the value put aside previously, to change the period of interruption by the counter 5, whereby fast forwarding mode during reproduction is canceled.

Figure 22:
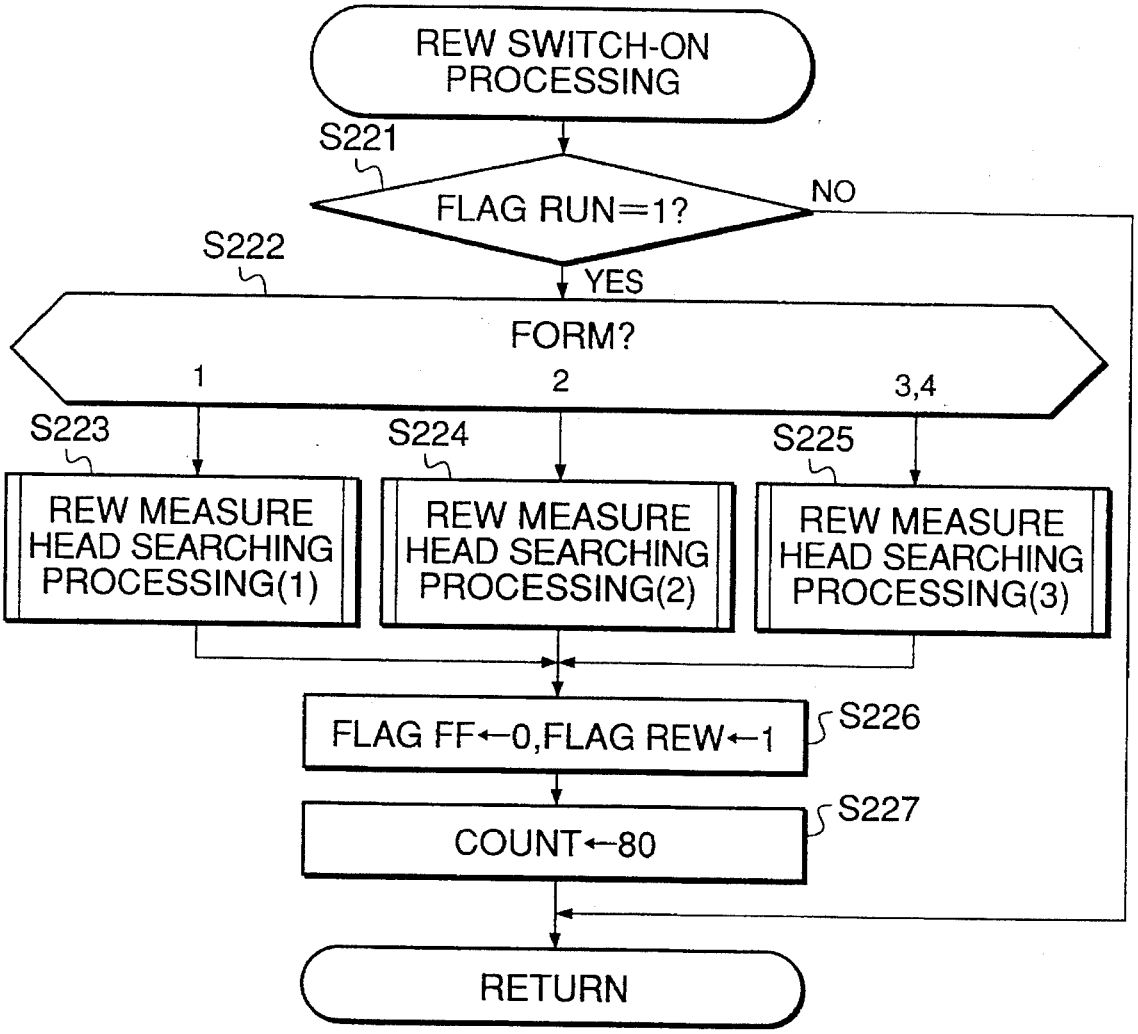
FIG. 22 is a flowchart showing a rewind (REW) switch-on processing executed by the switch processing of FIG. 6.

FIG. 22 shows a rewind switch-on processing. First, at a step S221, it is determined whether or not the flag RUN assumes 1. If the answer is YES, it is determined at a step S222 which value the register FORM indicative of the format of the song data assumes. If it assumes 1, 2, or 3 or 4, the program proceeds to steps S223, S224, or S225, respectively, to carry out respective REW measure head-searching processings. After execution of any of the REW measure head-searching processings, the flag FF is reset to 0 and the flag REW is set to 1 at a step S226, followed by setting the counter COUNT to 80 at a step S227.

Figure 23:
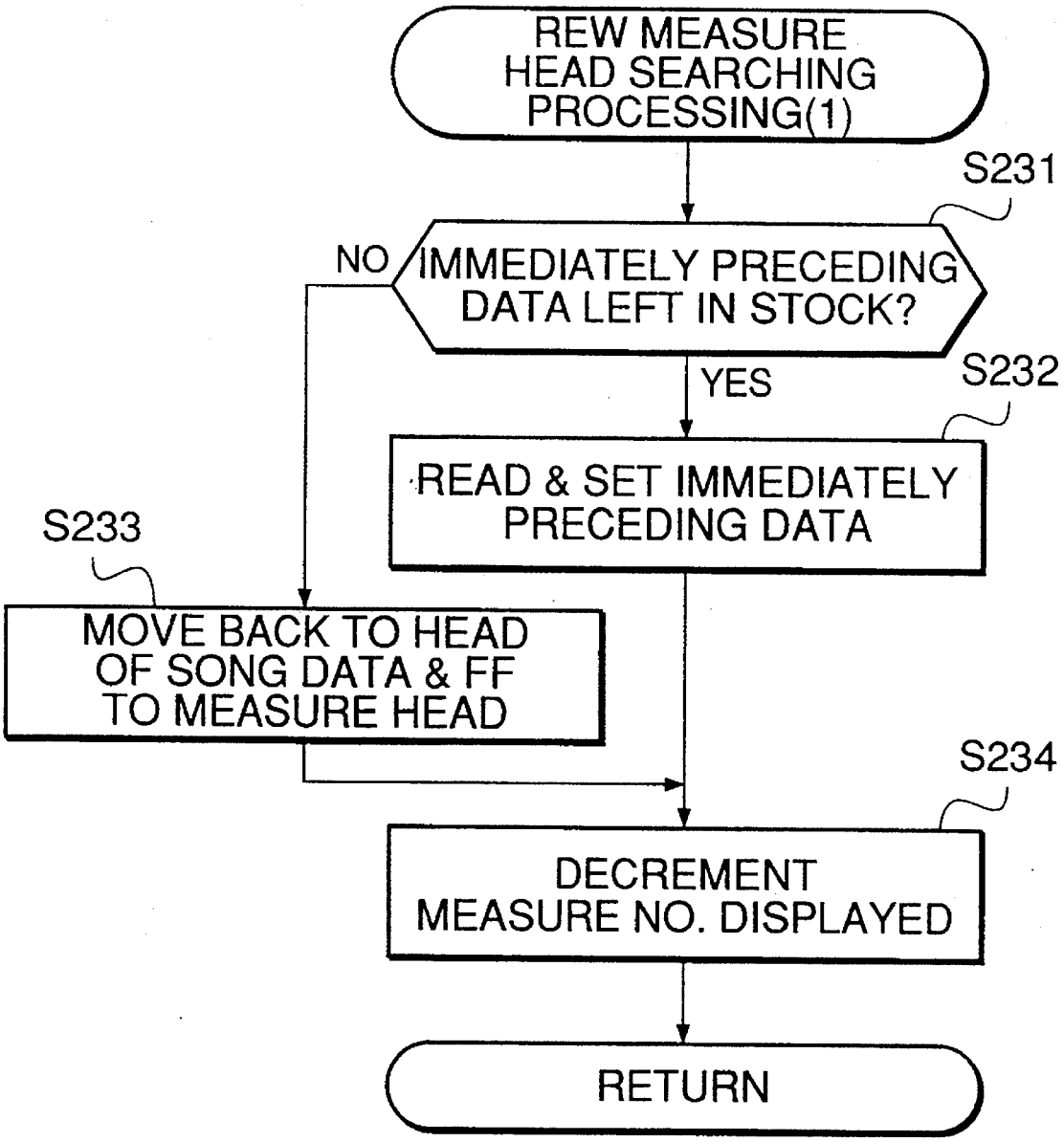
FIG. 23 is flowchart showing a REW measure head-searching processing (1) executed by the rewind switch-on processing of FIG. 23.

FIG. 23 shows details of the REW measure head-searching processing executed at the step S223 in FIG. 22. First, at a step S231, it is determined whether or not there is stored in the buffer data on immediately preceding measure location and condition (data written on the last occasion in the first loop of execution of the present routine after reproduction or fast forwarding, or data read out in the last loop of execution of the routine in the case where the present loop is the second loop or a subsequent loop). This step is for determining whether or not all the data on the measure location and condition, which were stored during the reproduction processing (1) and/or the FF measure head-searching processing (1), have been read out of the stock as the rewinding proceeds. If there is no such data left in stock, the answer is NO, and if there is still such data left in stock, the answer is YES. If the answer is YES, the immediately preceding stored data on the measure location and condition is read out to make various settings based thereon. More specifically, for example, the measure location is set into measure location control registers (an address control register for indicating a reading address on the automatic performance data memory (RAM), and a timing register for controlling timing before the next event), and the condition data (color parameter(s), effect parameter(s), tempo value, etc.) are used to set the tone color of musical tones generated from the tone generator circuit 8, the effect imparted by an effecter circuit, not shown, and the tempo value for a tempo control timer, not shown, respectively. By these settings, data which precedes by one measure is restored or reproduced. According to this method, there is no need to search a location preceding by one measure on the song data, enabling execution of the rewinding operation at a very high speed. On the other hand, if the answer to the question of the step S231 is NO, the reading pointer is returned to the head of the song data at a step S233, followed by effecting fast forwarding to bring the reading pointer to the desired measure location (the location to which the pointer was intended to return). By doing so, the head of the present measure is searched and a stock of stored data is again prepared, to enable execution of the step S232. After execution of the step S232 or S233, the measure number to be displayed is decremented by 1. In this way, the rewinding processing of song data of the format (1) is achieved.

Figure 24:
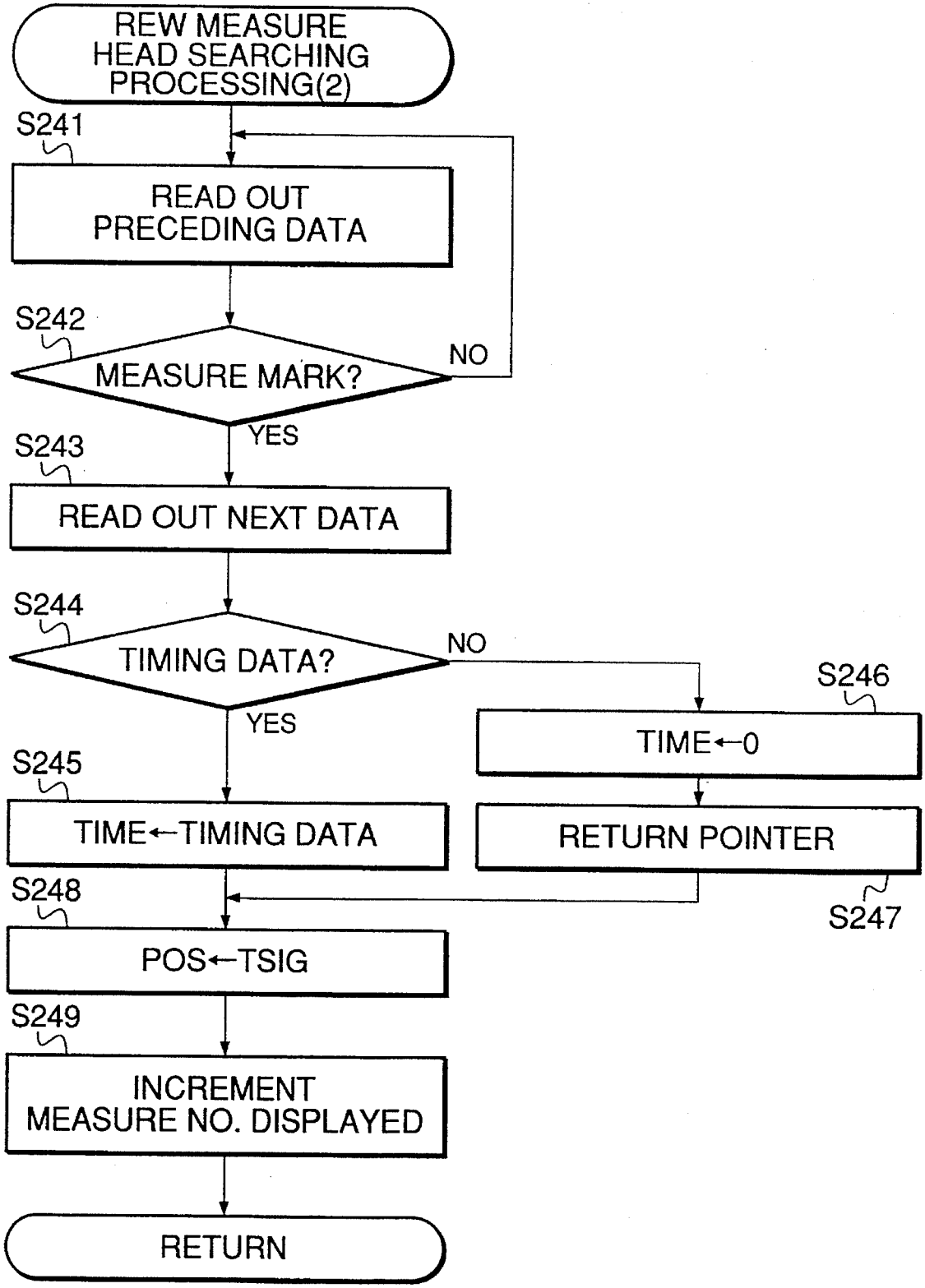
FIG. 24 is a flowchart showing a REW measure head-searching processing (2) executed by the rewind switch-on processing of FIG. 23.

FIG. 24 shows details of the REW measure head-searching processing (2) executed at the step S224 in FIG. 22. First, at a step S241, data immediately preceding the present reading pointer position is read out, and then at a step S242 it is determined whether or not the read-out immediately preceding data is a measure mark. This determination is repeated until the answer becomes YES. When the answer becomes YES, the program proceeds to a step S243, wherein the next or immediately following data is read out, followed by determining whether or not the read-out data is timing data. If the answer is YES, the value of the read-out timing data is stored into the register TIME at a step S244, whereas if the answer is NO, 0 is set into the register TIME, followed by moving back the reading pointer by one, i.e. to the immediately preceding position. Then, at a step S248, the value of the register TSIG is stored into the register POS, followed by making decrement of the measure number to be displayed at a step S249. In this way, the rewinding processing of song data of the format (2) is achieved. According to this processing, high speed searching can be made by searching measure marks.

Figure 25:
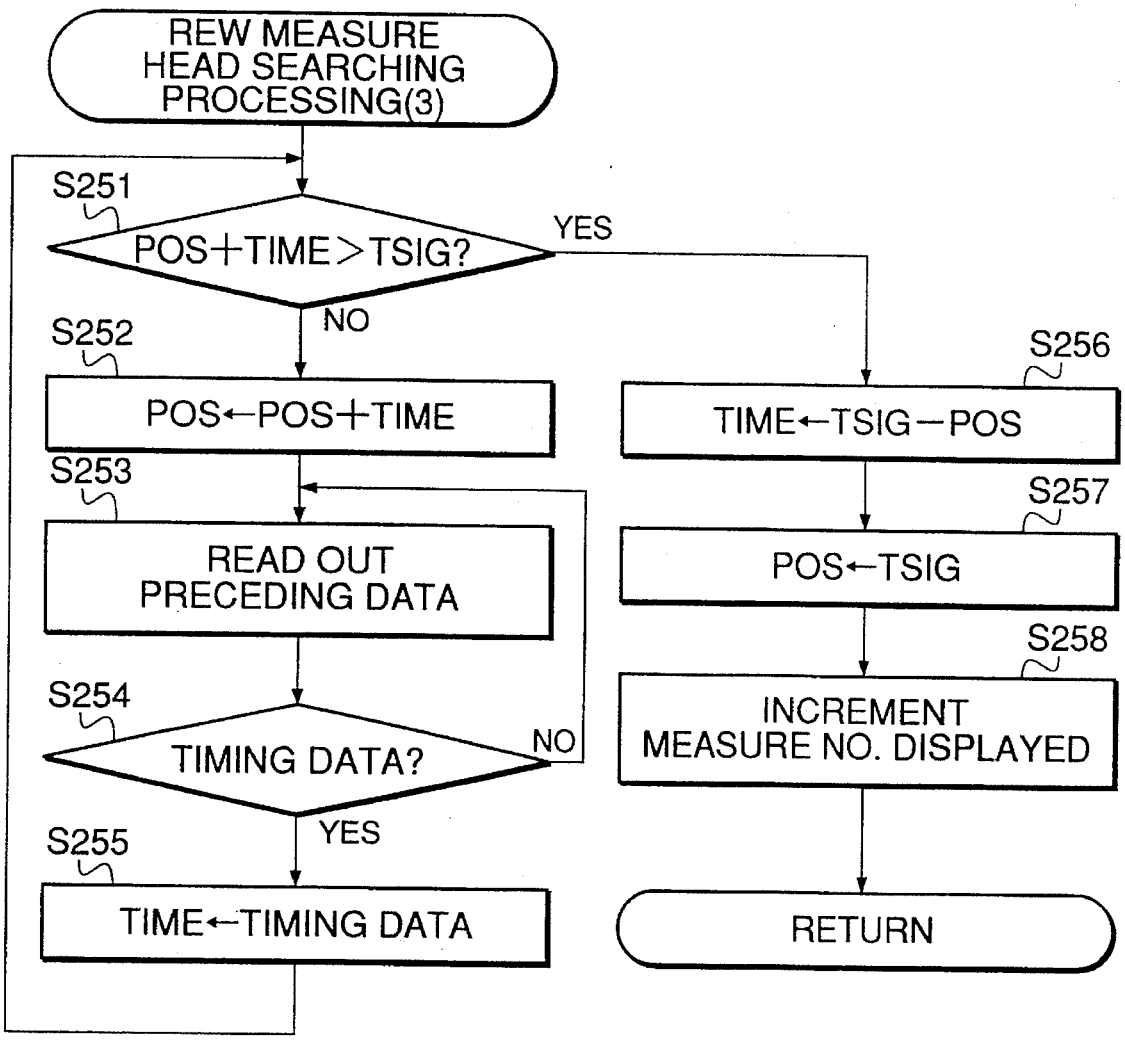
FIG. 25 is a flowchart showing a REW measure head-searching processing (3) executed by the rewind switch-on processing of FIG. 23.

FIG. 25 shows details of the REW measure head-searching processing (3) executed at the step S225 in FIG. 22. First, at a step S251, it is determined whether or not the sum of the register POS value and the register TIME value is larger than the value of the register TSIG. If the answer is NO, it means that the present position of the reading pointer has not yet reached the head of the measure after the present rewinding has been started. Then, at a step S252, the sum of the register POS value and the register TIME value is set into the register POS. At the next step S254, immediately preceding data is read out, and then it is determined at a step S254 whether or not the read-out data is timing data. If the answer is NO, the program returns to the step S253, whereas if the answer is YES, the timing data is stored into the register TIME at a step S255, followed by the program returning to the step S251. By repeating the above steps, the reading pointer position is progressively moved back. When subsequently the answer to the question of the step S251 becomes YES, that is, the reading pointer has moved back beyond the measure head, the sum of the register TSIG value and the register POS value is stored into the register TIME at a step S256, and then the register TSIG value is stored into the register POS at a step S257, thus setting data related to the measure head into the registers. At the next step S258, the measure number to be displayed is decremented by 1. In this way, the rewinding processing of song data of the format (3) or (4) is achieved.

Figure 26:
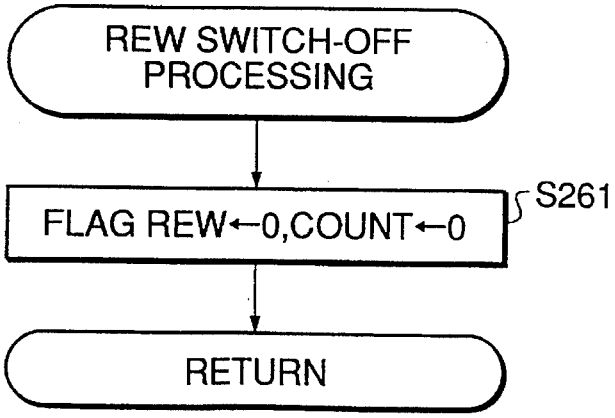
FIG. 26 is a flowchart showing a rewind switch-off processing executed by the switch processing of FIG. 6.

FIG. 26 shows a rewind switch-off processing. At a step S261, the flag REW and the counter COUNT are both reset to 0. By this resetting, continued pushing of the switch is no more detected in the timer interrupt processing.

According to the invention, the format in which automatic performance data is stored is not limited to those employed in the above described embodiment. For example, the time information may be expressed in terms, of absolute time within the measure, instead of relative time between events.

As described above, according to the invention, in searching the head location of a measure by counting time information in automatic performance information by one measure, the count value is corrected when time change information is read out, and the measure head location is searched based on the corrected count value. As a result, even when the time is changed at an intermediate position of the measure, it can be prevented that the reading pointer stops at a position different from the desired measure head.

Further, according to the invention, automatic performance information is sequentially read out measure by measure, in predetermined sequence according to music contained in the automatic performance information. Whenever reading-out of one measure is carried out, predetermined conditions set for the time point of the head of the measure are sequentially stored. Whenever rewinding of the automatic performance position is instructed, the stored condition related to an immediately preceding measure is read out and set, to thereby carry out rewinding measure by measure. Therefore, there is no need to search the head of each measure, enabling high speed searching.

Still further, according to the invention, first automatic performance information containing measure line information and second automatic performance information containing no measure line information are stored, and one of the two kinds of automatic performance information is selected. It is then detected whether the selected information is the first automatic performance information or the second automatic performance information. When searching is instructed, if the detected or selected information is the first automatic performance information, the searching point is advanced by one measure by searching the measure line information contained in the first automatic performance information, whereas if the detected or selected information is the second automatic performance information, the searching point is advanced by one measure by counting time information contained in the second automatic performance information, by one measure. As a result, searching can be achieved in an optimal manner depending upon the stored automatic performance information.

What is claimed is:

1. An automatic performance device comprising:

memory means for storing automatic performance information comprising timing information and performance information, said performance information containing time change information indicative of a change in time as a rate or tempo at which automatic performance is to be carried out;

instruction means for instructing updating of an automatic performance position within said automatic performance information measure by measure; and searching means responsive to an instruction from said instruction means, for searching a location of a head of a desired measure in said automatic performance information, by reading out said performance information of said automatic performance information from said memory means, based on said timing information, and counting a time period corresponding to each measure in said performance information read out to obtain a count value of said time period, and continuing said reading-out until said location of said head of said desired measure is searched out;

wherein when said time change information is read out during said searching, said searching means corrects said count value of said time period corresponding to one measure in which said time change information is read out, based on said time change information.

2. An automatic performance device as claimed in claim 1, wherein said searching means corrects said count value of said time period, based on a number of clocks corresponding to time contained in said time change information, said automatic performance information being read out from said memory means based on said clocks, and a difference between a time length of said one measure in which said time change information is read out, said time length corresponding to said time contained in said time change information, and a present value of said count value of said time period.

3. An automatic performance device comprising:

performance information memory means for storing automatic performance information.

reading means for sequentially reading out said automatic performance information from said performance information memory means, in predetermined sequence according to music contained in said automatic performance information;

condition memory means for storing information on at least one predetermined condition set for a time point of a head of each measure in said automatic performance information whenever said each measure is read out by said reading means, said condition memory means being capable of storing said information on said at least one predetermined condition for a plurality of measures in said automatic performance information;

rewinding instruction means for instructing rewinding of an automatic performance position within said automatic performance information; and rewinding means responsive to an instruction from said rewinding instruction means, for carrying out said rewinding of said automatic performance position measure by measure, by reading out said information on said at least one predetermined condition related to an immediately preceding measure in said automatic performance information whenever said rewinding is instructed by said rewinding instruction means.

4. An automatic performance device as claimed in claim 3, wherein said information on said at least one predetermined condition set for the time point of said head of said each measure includes information on an address in said performance information memory means at which is stored a portion of said automatic performance information corresponding to timing of said head end of said each measure.

5. An automatic performance device as claimed in claim 3, wherein said information on said at least one predetermined condition set for the time point of said head of said each measure includes at least one of information on tone color, information on effect, and information on tempo.

6. An automatic performance device as claimed in claim 3, wherein said rewinding instruction means includes a continuously operable switch, said rewinding instruction means generating an instruction for said rewinding whenever said switch is operated, and generating an instruction for said rewinding whenever a predetermined time period elapses so long as said switch is continuously operated.

7. An automatic performance device as claimed in claim 3, further including second rewinding means for carrying out rewinding of said position of said automatic performance in a manner such that said second rewinding means carries out rewinding of said automatic performance position by moving back said automatic performance position to a starting point of said automatic performance information, and then fast forwarding said automatic performance position to a location of a desired measure in said automatic performance position, and changeover means for changing said first-mentioned rewinding means over to said second rewinding means for carrying out rewinding of said automatic performance position when said rewinding instruction means instructs rewinding over a number of measures greater than a number of said information on said at least one predetermined condition stored in said condition memory means.

8. An automatic performance device comprising:

memory means for storing first automatic performance information containing measure line information, and second automatic performance information exclusive of measure line information, said first automatic performance information and said second automatic performance information each comprising timing information and performance information;

selecting means for selecting one of said first automatic performance information and said second automatic performance information from said memory means;

detecting means for detecting whether automatic performance information selected by said selecting means is said first automatic performance information or said second automatic performance information;

reading means for reading out said performance information selected by said selecting means, based on said timing information of said selected automatic performance information;

searching instruction means for instructing searching of a desired location in said selected automatic performance information; and searching means responsive to an instruction from said searching instruction means, for moving forward an automatic performance position along said selected automatic performance information measure by measure, by searching said measure line information contained in said first automatic performance information and moving forward said automatic performance position by one measure whenever said measure line information is searched when selection of said first automatic performance information is detected by said detecting means, and by counting a time period corresponding to each measure in said second automatic performance information and moving forward said automatic performance position by one measure whenever said time period corresponding to each measure is counted up when selection of said second automatic performance is detected by said detecting means.

* * * * *